US011484180B2

(12) United States Patent
Dietrich et al.

(10) Patent No.: US 11,484,180 B2
(45) Date of Patent: Nov. 1, 2022

(54) DISHWASHER WITH TUBULAR SPRAY ELEMENT INCLUDING MULTIPLE SELECTABLE SPRAY PATTERNS

(71) Applicant: Midea Group Co., Ltd., Foshan (CN)

(72) Inventors: Russell Dietrich, Taylorsville, KY (US); Bassam Fawaz, Louisville, KY (US); Joel Boyer, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 77 days.

(21) Appl. No.: 17/095,415

(22) Filed: Nov. 11, 2020

(65) Prior Publication Data

US 2022/0142452 A1 May 12, 2022

(51) Int. Cl.
*A47L 15/42* (2006.01)
*A47L 15/00* (2006.01)

(52) U.S. Cl.
CPC ..... *A47L 15/4282* (2013.01); *A47L 15/0018* (2013.01); *A47L 15/428* (2013.01)

(58) Field of Classification Search
None
See application file for complete search history.

(56) References Cited

U.S. PATENT DOCUMENTS 2,734,520 A 2/1956 Abresch
2,808,063 A 10/1957 Abresch et al.
2,907,335 A 10/1959 Abresch
2,914,255 A 11/1959 Jepson
2,939,465 A 6/1960 Kesling
2,956,572 A 10/1960 Levit et al.
2,973,907 A 3/1961 Abresch et al.
2,980,120 A 4/1961 Jacobs
3,006,557 A 10/1961 Jacobs
(Continued)

FOREIGN PATENT DOCUMENTS

CN 2094961 U 2/1992
CN 2395683 Y 9/2000
(Continued)

OTHER PUBLICATIONS

International Search Report and Written Opinion issued in Application No. PCT/CN2021/126290, 10 pages, dated Jan. 28, 2022.
(Continued)

*Primary Examiner* — Rita P Adhlakha
(74) *Attorney, Agent, or Firm* — Middleton Reutlinger

(57) ABSTRACT

A dishwasher, dishwasher sprayer, and method of spraying utilize a tubular spray element with multiple selectable spray patterns that can be used during a wash cycle. In some instances, multiple selectable spray patterns may be supported through the use of a multi-walled tubular spray element having concentric wall sections that are movable relative to one another to selectively activate one or more apertures and thereby modify a spray pattern emitted by the tubular spray element. In other instances, multiple selectable spray patterns may be supported through the use of a multi-chamber tubular spray element in which different sets of apertures are in fluid communication with different chambers in the tubular spray element and flow is selectively controlled to one or more of the chambers.

16 Claims, 8 Drawing Sheets

(56) References Cited

U.S. PATENT DOCUMENTS 3,026,046 A 3/1962 Wickham et al.
3,044,842 A 7/1962 Abresch et al.
3,051,183 A 8/1962 Jacobs
3,077,200 A 2/1963 Guth
3,082,779 A 3/1963 Jacobs
3,088,474 A 5/1963 Leslie
3,101,730 A 8/1963 Harris et al.
3,115,306 A 12/1963 Graham
3,178,117 A 4/1965 Hanifan
3,192,935 A 7/1965 Hanifan
3,210,010 A 10/1965 Delapena
3,282,509 A 11/1966 Starr
3,324,867 A 6/1967 Freese
3,348,775 A 10/1967 Flame
3,361,361 A 1/1968 Schutte
3,454,784 A 7/1969 Wantz et al.
3,538,927 A 11/1970 Harald
3,586,011 A 6/1971 Mazza
3,590,688 A 7/1971 Brannon
3,596,834 A 8/1971 Cushing
3,719,323 A 3/1973 Raiser
3,767,118 A 10/1973 Oberto et al.
4,175,575 A 11/1979 Cushing
4,226,490 A 10/1980 Jenkins et al.
4,301,822 A 11/1981 Dingler
4,398,562 A 8/1983 Saarem et al.
4,519,544 A 5/1985 Szabo
4,657,188 A 4/1987 Crane et al.
4,718,440 A 1/1988 Hawker et al.
4,732,323 A 3/1988 Jarvis et al.
4,822,241 A 4/1989 Jarvis et al.
5,211,190 A 5/1993 Johnson et al.
5,226,454 A 7/1993 Cabalfin
5,341,827 A 8/1994 Kim
5,511,727 A 4/1996 Heren et al.
5,697,392 A 12/1997 Johnson et al.
5,725,002 A 3/1998 Payzant
5,752,533 A 5/1998 Edwards
5,927,616 A 7/1999 Grise et al.
6,053,185 A 3/2000 Cirjak et al.
6,431,188 B1 8/2002 Laszczewski, Jr. et al.
6,612,009 B1 9/2003 Laszczewski, Jr. et al.
6,694,990 B2 2/2004 Spanyer et al.
6,869,029 B2 3/2005 Ochoa et al.
6,945,471 B2 9/2005 McKenzie et al.
7,032,837 B2 4/2006 Eddins et al.
7,055,537 B2 6/2006 Elick et al.
7,210,315 B2 5/2007 Castelli et al.
7,293,435 B2 11/2007 Elexpuru et al.
7,445,013 B2 11/2008 VanderRoest et al.
7,464,718 B2 12/2008 McIntyre et al.
7,556,049 B2 7/2009 Oakes et al.
7,587,916 B2 9/2009 Rizzetto
7,594,513 B2 9/2009 VanderRoest et al.
7,607,325 B2 10/2009 Elexpuru et al.
7,650,765 B2 1/2010 Rizzetto
7,914,625 B2 3/2011 Bertsch et al.
7,935,194 B2 5/2011 Rolek
8,136,537 B2 3/2012 Cerrano et al.
8,161,995 B2 4/2012 Armstrong et al.
8,191,560 B2 6/2012 Mallory et al.
8,443,765 B2 5/2013 Hollis
8,696,827 B2 4/2014 Ashrafzadeh et al.
8,778,094 B2 7/2014 Blanchard et al.
8,844,838 B2 9/2014 Funseth et al.
8,858,729 B2 10/2014 Buddharaju et al.
8,900,375 B2 12/2014 Gnadinger et al.
8,915,257 B2 12/2014 Büsing et al.
8,932,411 B2 1/2015 Beaudet et al.
8,978,674 B2 3/2015 Buesing
8,985,128 B2 3/2015 Pyo et al.
9,121,217 B1 9/2015 Hoffberg
9,170,584 B2 10/2015 Lum et al.
9,204,780 B2 12/2015 Francisco et al.
9,220,393 B2 12/2015 Becker et al.
9,241,604 B2 1/2016 Dries
9,259,137 B2 2/2016 Boyer et al.
9,265,400 B2 2/2016 Bigott
9,307,888 B2 4/2016 Baldwin et al.
9,326,657 B2 5/2016 Thiyagarajan
9,480,389 B2 11/2016 Haft et al.
9,492,055 B2 11/2016 Feddema
9,532,700 B2 1/2017 Welch
9,635,994 B2 5/2017 Boyer et al.
9,655,496 B2 5/2017 Baldwin et al.
9,915,356 B2 3/2018 Chang et al.
9,958,073 B2 5/2018 Yang
10,524,634 B2 1/2020 Digman
10,531,781 B2 1/2020 Digman et al.
10,631,708 B2 4/2020 Digman et al.
10,765,291 B2 9/2020 Digman et al.
2002/0092931 A1 7/2002 Coote
2005/0011544 A1 1/2005 Rosenbauer et al.
2005/0139240 A1 6/2005 Bong et al.
2005/0241680 A1 11/2005 Noh
2005/0241681 A1 11/2005 Hwang
2006/0278258 A1 12/2006 Kara et al.
2007/0215187 A1 9/2007 Koch
2008/0163904 A1 7/2008 Hwang
2008/0271765 A1 11/2008 Burrows
2008/0276975 A1 11/2008 Disch
2009/0071508 A1 3/2009 Sundaram et al.
2009/0090400 A1 4/2009 Burrows et al.
2009/0145468 A1 6/2009 Chericoni
2010/0043826 A1 2/2010 Bertsch et al.
2011/0186085 A1 8/2011 Chen et al.
2012/0060875 A1 3/2012 Fauth et al.
2012/0175431 A1 7/2012 Althammer et al.
2012/0291827 A1 11/2012 Buddharaju et al.
2013/0000762 A1 1/2013 Buddharaju et al.
2013/0068265 A1 3/2013 Gnadinger et al.
2013/0319483 A1 12/2013 Welch
2014/0059880 A1 3/2014 Bertsch et al.
2014/0069470 A1 3/2014 Baldwin et al.
2014/0332041 A1* 11/2014 Feddema ..... A47L 15/23 134/178
2014/0373876 A1 12/2014 Feddema
2015/0007861 A1 1/2015 Azmi et al.
2015/0266065 A1 9/2015 Savoia
2016/0198928 A1 7/2016 Xu et al.
2017/0135548 A1 5/2017 Swarnkar
2017/0181599 A1 6/2017 Choi et al.
2017/0224190 A1 8/2017 Sakthivel et al.
2017/0265707 A1 9/2017 Roderick et al.
2017/0273535 A1 9/2017 Roderick et al.
2017/0354308 A1 12/2017 Choi et al.
2018/0084967 A1 3/2018 Ross et al.
2018/0110397 A1 4/2018 Kim et al.
2018/0132692 A1 5/2018 Dries
2018/0168425 A1 6/2018 Wilson et al.
2018/0192851 A1 7/2018 Gursoy et al.
2018/0333037 A1 11/2018 Roderick et al.
2018/0360293 A1 12/2018 Boyer
2019/0059688 A1 2/2019 Woo et al.
2019/0099054 A1 4/2019 Digman et al.
2019/0099056 A1 4/2019 Digman
2019/0191959 A1 6/2019 Brightbill et al.
2019/0290095 A1 9/2019 Wahlberg et al.
2019/0307308 A1 10/2019 Haegermarck
2020/0077868 A1 3/2020 Digman et al.
2020/0085277 A1 3/2020 Digman et al.
2020/0085278 A1* 3/2020 Digman ..... A47L 15/4282
2020/0085279 A1 3/2020 Digman et al.
2020/0107696 A1 4/2020 Digman et al.
2020/0288940 A1 9/2020 Fawaz et al.

FOREIGN PATENT DOCUMENTS

CN 1879547 A 12/2006
CN 101049224 A 10/2007
CN 101134198 A 3/2008
CN 201067392 Y 6/2008
CN 101795613 A 8/2010
CN 102370450 A 3/2012

(56) References Cited

FOREIGN PATENT DOCUMENTS

| | | | |
|---|---|---|---|
| CN | 102512128 | A | 6/2012 |
| CN | 102940476 | A | 2/2013 |
| CN | 203447254 | U | 2/2014 |
| CN | 203749364 | U | 8/2014 |
| CN | 203763025 | U | 8/2014 |
| CN | 104433985 | A | 3/2015 |
| CN | 104523208 | A | 4/2015 |
| CN | 104545744 | A | 4/2015 |
| CN | 104545745 | A | 4/2015 |
| CN | 204363922 | U | 6/2015 |
| CN | 104757921 | A | 7/2015 |
| CN | 204467993 | U | 7/2015 |
| CN | 104840165 | A | 8/2015 |
| CN | 204671085 | U | 9/2015 |
| CN | 10514721 | A | 12/2015 |
| CN | 105231971 | A | 1/2016 |
| CN | 205094364 | U | 3/2016 |
| CN | 105286746 | B | 2/2018 |
| CN | 208677329 | U | 4/2019 |
| DE | 3537184 | A1 | 4/1987 |
| DE | 20113227 | U1 | 10/2001 |
| DE | 10121083 | A1 | 10/2002 |
| DE | 10300501 | A1 | 7/2004 |
| DE | 202004013786 | U1 | 12/2004 |
| DE | 102008011743 | A1 | 9/2009 |
| DE | 202014010365 | U1 | 5/2015 |
| EP | 0559466 | A1 | 9/1993 |
| EP | 0679365 | A1 | 11/1995 |
| EP | 0764421 | A1 | 3/1997 |
| EP | 0786231 | A2 | 7/1997 |
| EP | 0864291 | A1 | 9/1998 |
| EP | 1132038 | A2 | 9/2001 |
| EP | 1136030 | A1 | 9/2001 |
| EP | 1238622 | A2 | 9/2002 |
| EP | 1252856 | A2 | 10/2002 |
| EP | 1632166 | A2 | 3/2006 |
| EP | 1758494 | A1 | 3/2007 |
| EP | 2636786 | A1 | 9/2013 |
| EP | 2059160 | B1 | 3/2015 |
| EP | 3488756 | A1 | 5/2019 |
| FR | 1473796 | A | 3/1967 |
| GB | 572623 | A | 10/1945 |
| GB | 2244209 | A | 11/1991 |
| JP | 2003339607 | A | 12/2003 |
| JP | 2014121353 | A | 7/2014 |
| KR | 100786069 | B1 | 12/2007 |
| KR | 200442414 | Y1 | 11/2008 |
| KR | 101173691 | B1 | 8/2012 |
| KR | 200464747 | Y1 | 1/2013 |
| WO | 2009008827 | A1 | 1/2009 |
| WO | 2016008699 | A1 | 1/2016 |
| WO | WO2016123736 | A1 | 8/2016 |
| WO | 2017022974 | A1 | 2/2017 |
| WO | 2018053635 | A1 | 3/2018 |
| WO | 2018107833 | A1 | 6/2018 |
| WO | 2018107834 | A1 | 6/2018 |
| WO | 2018107835 | A1 | 6/2018 |
| WO | WO2019042665 | A1 | 3/2019 |

OTHER PUBLICATIONS

Electrolux Home Products, Inc. "Dishwasher Use & Care Guide 1500 Series with Fully Electronic Control" 2003.

Scribd, Sears Kenmore Elite 2013 Stainless Steel Tall Tub Dishwasher Service Manual, www.scribd.com, Retrieved on Dec. 5, 2018.

Everyspec, Federal Specification: Dishwashing Machines, Single Tank and Double Tank, Commercial, www.everyspec.com, Oct. 17, 1983.

Encyclo, "Keyed Connector—Definition—Encyclo", https://www.encyclo.co.uk/meaning-of-Keyed_connectors, 2020.

International Search Report and Written Opinion issued in Application No. PCT/CN2019/078611 dated Jun. 5, 2019.

International Search Report and Written Opinion issued in Application No. PCT/CN2018/074294 dated Jul. 5, 2018.

International Search Report and Written Opinion issued in Application No. PCT/CN2018/074268 dated Jul. 13, 2018.

International Search Report and Written Opinion issued in Application No. PCT/CN2019/079236 dated Jun. 25, 2019.

International Search Report and Written Opinion issued in Application No. PCT/CN2019/078799 dated Jun. 26, 2019.

International Search Report and Written Opinion issued in Application No. PCT/CN2019/078612 dated Jun. 28, 2019.

International Search Report and Written Opinion issued in Application No. PCT/CN2019/097332 dated Dec. 9, 2019.

U.S. Patent and Trademark Office, Office Action ssued in U.S. Appl. No. 16/132,106 dated Jul. 23, 2020.

Rainbirdcorp, Rain Bird R-Van: A Complete Line of Rotary Nozzles, Retrieved from: https://www.youtube.com/watch?v=VtTg0LodNzQ, Apr. 2, 2018.

* cited by examiner

DISHWASHER WITH TUBULAR SPRAY ELEMENT INCLUDING MULTIPLE SELECTABLE SPRAY PATTERNS

BACKGROUND

Dishwashers are used in many single-family and multi-family residential applications to clean dishes, silverware, cutlery, cups, glasses, pots, pans, etc. (collectively referred to herein as "utensils"). Many dishwashers rely primarily on rotatable spray arms that are disposed at the bottom and/or top of a tub and/or are mounted to a rack that holds utensils. A spray arm is coupled to a source of wash fluid and includes multiple apertures for spraying wash fluid onto utensils, and generally rotates about a central hub such that each aperture follows a circular path throughout the rotation of the spray arm. The apertures may also be angled such that force of the wash fluid exiting the spray arm causes the spray arm to rotate about the central hub.

While traditional spray arm systems are simple and mostly effective, they have the shortcoming that they must spread the wash fluid over all areas equally to achieve a satisfactory result. In doing so, resources such as time, energy and water are generally wasted because wash fluid cannot be focused precisely where it is needed. Moreover, because spray arms follow a generally circular path, the corners of a tub may not be covered as thoroughly, leading to lower cleaning performance for utensils located in the corners of a rack. In addition, in some instances the spray jets of a spray arm may be directed to the sides of a wash tub during at least portions of the rotation, leading to unneeded noise during a wash cycle.

A different approach to traditional spray arm systems utilizes one or more tubular spray elements to spray utensils within a dishwasher. A tubular spray element is a type of rotatable conduit that both conveys wash fluid along its length and ejects the wash fluid through various apertures disposed on an exterior surface thereof. A tubular spray element is generally formed of an elongated body and rotates about a longitudinal axis thereof, either in a controllable or uncontrollable fashion, e.g., based upon an electric drive, a hydraulic drive, or as a result of rotational forces imparted by the ejection of wash fluid from the tubular spray element.

It has been found, however, that in some instances the arrangement of apertures on a tubular spray element may generate a spray pattern that is better suited for some applications than for others. The effectiveness of a particular spray pattern may vary based upon the placement of utensils within a dishwasher as well as the types of utensils and the amount of soiling thereon. A spray pattern that directs a few high pressure jets at a limited number of locations may be useful for heavily soiled items that are positioned within those locations, yet may not be as useful for a fully loaded dishwasher where multiple utensils are located in areas where gaps exist in the spray pattern. Since the manner in which utensils may be loaded into a dishwasher can vary substantially from cycle to cycle, tradeoffs are generally made in the design of the spray pattern to provide acceptable performance across the various types of loads that a dishwasher may encounter.

SUMMARY

The herein-described embodiments address these and other problems associated with the art by providing a dishwasher, dishwasher sprayer, and method of spraying in which a tubular spray element is provided with multiple selectable spray patterns that can be used during a wash cycle. In some instances, multiple selectable spray patterns may be supported through the use of a multi-walled tubular spray element having concentric wall sections that are movable relative to one another to selectively activate one or more apertures and thereby modify a spray pattern emitted by the tubular spray element. In other instances, multiple selectable spray patterns may be supported through the use of a multi-chamber tubular spray element in which different sets of apertures are in fluid communication with different internal chambers in the tubular spray element and flow is selectively controlled to one or more of the chambers.

Therefore, consistent with one aspect of the invention, a dishwasher may include a wash tub, a fluid supply configured to supply a wash fluid, and a tubular spray element disposed within the wash tub and being rotatable about a longitudinal axis thereof, the tubular spray element including a plurality of apertures in fluid communication with the fluid supply to direct wash fluid into the wash tub, and the tubular spray element having a plurality of selectable spray patterns that differ from one another, each of the plurality of selectable spray patterns configured to direct wash fluid from at least a subset of the plurality of apertures.

Some embodiments may also include a tubular spray element drive coupled to the tubular spray element and configured to rotate the tubular spray element about the longitudinal axis, and a controller coupled to the tubular spray element drive to control rotation of the tubular spray element, the controller further configured to control selection of a spray pattern among the plurality of selectable spray patterns for the tubular spray element such that the tubular spray element operates using multiple selectable spray patterns during a wash cycle.

Also, in some embodiments, the controller is configured to control selection of the spray pattern by controlling rotation of the tubular spray element with the tubular spray element drive. In addition, some embodiments may further include a tubular spray element spray pattern selector configured to select from among the plurality of selectable spray patterns, and the controller is configured to control selection of the spray pattern by controlling the tubular spray element spray pattern selector independent of rotation of the tubular spray element by the tubular spray element drive.

Further, in some embodiments, the plurality of selectable spray patterns include first and second selectable spray patterns, the tubular spray element is a multi-walled tubular spray element having first and second concentric wall sections, the first concentric wall section includes a first set of apertures from the plurality of apertures and the second concentric wall section includes a second set of apertures from the plurality of apertures, the first and second concentric wall sections are movable relative to one another between at least first and second positions, when the first and second concentric wall sections are in the first position, at least a first subset of apertures from the first set of apertures is aligned with at least a first subset of apertures from the second set of apertures such that wash fluid from the fluid supply is emitted through the first subsets of apertures of the first and second sets of apertures to form the first selectable spray pattern, and when the first and second concentric wall sections are in the second position, at least a second subset of apertures from the first set of apertures is aligned with at least a second subset of apertures from the second set of apertures such that wash fluid from the fluid supply is emitted through the second subsets of apertures of the first and second sets of apertures to form the second selectable spray pattern that is different from the first selectable spray pattern.

In some embodiments, the first and second concentric wall sections fully circumscribe the longitudinal axis of the tubular spray element. In addition, in some embodiments, at least one of the first and second concentric wall sections does not fully circumscribe the longitudinal axis of the tubular spray element. In some embodiments, the first and second concentric wall sections are movable relative to one another along the longitudinal axis of the tubular spray element to select between the first and second selectable spray patterns. In addition, in some embodiments, the first and second concentric wall sections are rotatable relative to one another about the longitudinal axis of the tubular spray element to select between the first and second selectable spray patterns.

In addition, some embodiments may further include first and second rotational limits configured to limit relative rotation of the first and second concentric wall sections beyond each of the first and second positions, and a tubular spray element drive coupled to the tubular spray element and configured to rotate the second concentric wall section of the tubular spray element about the longitudinal axis. When the tubular spray element drive rotates the second concentric wall section of the tubular spray element in a first direction, the first rotational limit maintains the first and second concentric wall sections in the first position, when the tubular spray element drive rotates the second concentric wall section of the tubular spray element in a second direction, the second rotational limit maintains the first and second concentric wall sections in the second position, and when the tubular spray element drive reverses rotation between the first and second directions, the first and second concentric wall sections rotate between the first and second positions. Some embodiments may also include a frictional coupling coupled to the first concentric wall section to restrict rotation of the first concentric wall section to facilitate rotation of the first and second concentric wall sections between the first and second positions when the tubular spray element drive reverses rotation.

In some embodiments, the first and second subsets of apertures from the second set of apertures are the same. Moreover, in some embodiments, the first and second subsets of apertures from the first set of apertures are different, and the first concentric wall section is housed within the second concentric wall section.

In some embodiments, the plurality of apertures includes a first set of apertures configured to emit a first selectable spray pattern from among the plurality of selectable spray patterns and a second set of apertures configured to emit a second selectable spray pattern from among the plurality of selectable spray patterns that is different from the first selectable spray pattern, the tubular spray element further includes a plurality of internal chambers extending along the longitudinal axis, and the dishwasher further includes a diverter valve coupled intermediate the tubular spray element and the fluid supply and configured to restrict fluid flow to at least one of the plurality of internal chambers while allowing fluid flow to at least one other of the plurality of internal chambers during rotation of the tubular spray element such that when the first set of apertures is aligned with an internal chamber among the plurality of internal chambers to which fluid flow is allowed and the second set of apertures is aligned with an internal chamber among the plurality of internal chambers to which fluid flow is restricted, wash fluid is emitted from the first set of apertures in the first selectable spray pattern, and when the first set of apertures is aligned with an internal chamber among the plurality of internal chambers to which fluid flow is restricted and the second set of apertures is aligned with an internal chamber among the plurality of internal chambers to which fluid flow is allowed, wash fluid is emitted from the second set of apertures in the second selectable spray pattern.

In addition, in some embodiments, the first and second sets of apertures are circumferentially offset from one another about the longitudinal axis. In some embodiments, the tubular spray element includes an outer wall through which the plurality of apertures project and an internal partition that defines the plurality of internal chambers. Moreover, in some embodiments, the internal partition rotates with the outer wall during rotation of the tubular spray element such that the first and second sets of apertures remain aligned with respective first and second internal chambers among the plurality of internal chambers during rotation of the tubular spray element and such that the diverter valve restricts fluid flow to different internal chambers at different rotational positions of the tubular spray element.

Also, in some embodiments, the outer wall rotates relative to the internal partition during rotation of the tubular spray element such that the first and second sets of apertures align with different internal chambers among the plurality of internal chambers during rotation of the tubular spray element. In some embodiments, the internal partition is maintained at a fixed rotational position relative to the diverter valve such that the diverter valve allows fluid flow to at least one of the internal chambers among the plurality of internal chambers throughout rotation of the tubular spray element.

Consistent with another aspect of the invention, a dishwasher may include a wash tub, a fluid supply configured to supply a wash fluid, and a multi-walled tubular spray element disposed within the wash tub and being rotatable about a longitudinal axis thereof. The tubular spray element is in fluid communication with the fluid supply and has first and second concentric wall sections, the first concentric wall section includes a first set of apertures and the second concentric wall section includes a second set of apertures, the first and second concentric wall sections are movable relative to one another between at least first and second positions, when the first and second concentric wall sections are in the first position, at least a first subset of apertures from the first set of apertures is aligned with at least a first subset of apertures from the second set of apertures such that wash fluid from the fluid supply is emitted through the first subsets of apertures of the first and second sets of apertures to form a first selectable spray pattern, and when the first and second concentric wall sections are in the second position, at least a second subset of apertures from the first set of apertures is aligned with at least a second subset of apertures from the second set of apertures such that wash fluid from the fluid supply is emitted through the second subsets of apertures of the first and second sets of apertures to form a second selectable spray pattern that is different from the first selectable spray pattern.

Consistent with another aspect of the invention, a dishwasher may include a wash tub, a fluid supply configured to supply a wash fluid, a multi-chambered tubular spray element disposed within the wash tub and being rotatable about a longitudinal axis thereof, the tubular spray element including a plurality of apertures in fluid communication with the fluid supply to direct wash fluid into the wash tub, the plurality of apertures including a first set of apertures configured to emit a first selectable spray pattern and a second set of apertures configured to emit a second selectable spray pattern that is different from the first selectable spray pattern, the tubular spray element further including a plurality of internal chambers extending along the longitudinal axis, and a diverter valve coupled intermediate the tubular spray element and the fluid supply and configured to restrict fluid flow to at least one of the plurality of internal chambers while allowing fluid flow to at least one other of the plurality of internal chambers during rotation of the tubular spray element such that when the first set of apertures is aligned with an internal chamber among the plurality of internal chambers to which fluid flow is allowed and the second set of apertures is aligned with an internal chamber among the plurality of internal chambers to which fluid flow is restricted, wash fluid is emitted from the first set of apertures in the first selectable spray pattern, and when the first set of apertures is aligned with an internal chamber among the plurality of internal chambers to which fluid flow is restricted and the second set of apertures is aligned with an internal chamber among the plurality of internal chambers to which fluid flow is allowed, wash fluid is emitted from the second set of apertures in the second selectable spray pattern.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
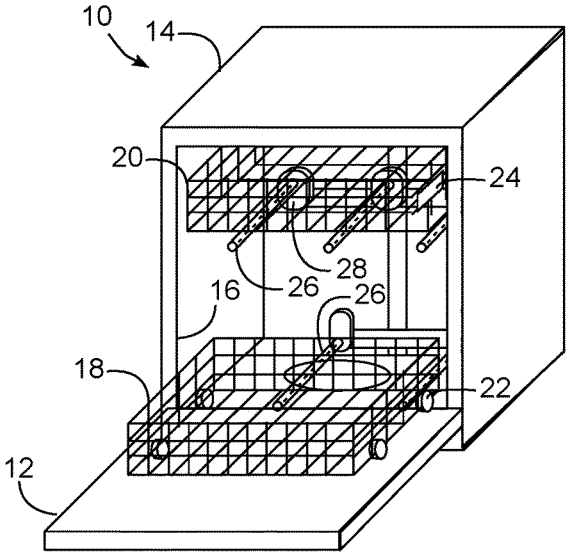
FIG. 1 is a perspective view of a dishwasher consistent with some embodiments of the invention.

In some embodiments consistent with the invention, a tubular spray element may support multiple selectable spray patterns that can be used during a wash cycle. In some instances, multiple selectable spray patterns may be supported through the use of a multi-walled tubular spray element having concentric wall sections that are movable relative to one another to selectively activate one or more apertures and thereby modify a spray pattern emitted by the tubular spray element. In other instances, multiple selectable spray patterns may be supported through the use of a multi-chamber tubular spray element in which different sets of apertures are in fluid communication with different internal chambers in the tubular spray element and flow is selectively controlled to one or more of the chambers.

A tubular spray element, in this regard, may be considered to be a type of rotatable conduit that includes a body capable of communicating a fluid such as water, a wash fluid including water, detergent and/or another treatment composition, or pressurized air, and that is capable of communicating the fluid to one or more apertures or nozzles to spray fluid onto utensils within a wash tub. A tubular spray element generally includes an elongated body, which may be generally cylindrical in some embodiments but may also have other cross-sectional profiles in other embodiments, and which has one or more apertures disposed on an exterior surface thereof and in fluid communication with a fluid supply, e.g., through one or more internal passageways defined therein. A tubular spray element also has a longitudinal axis generally defined along its longest dimension and about which the tubular spray element rotates. Further, when a tubular spray element is mounted on a rack and configured to selectively engage with a dock based upon the position of the rack, this longitudinal axis may also be considered to be an axis of insertion. A tubular spray element may also have a cross-sectional profile that varies along the longitudinal axis, so it will be appreciated that a tubular spray element need not have a circular cross-sectional profile along its length as is illustrated in a number embodiments herein. In addition, the one or more apertures on the exterior surface of a tubular spray element may be arranged into nozzles in some embodiments, and may be fixed or movable (e.g., rotating, oscillating, etc.) with respect to other apertures on the tubular spray element. Further, the exterior surface of a tubular spray element may be defined on multiple components of a tubular spray element, i.e., the exterior surface need not be formed by a single integral component.

In addition, in some embodiments a tubular spray element may be discretely directed by a tubular spray element drive to multiple rotational positions about the longitudinal axis to spray a fluid in predetermined directions into a wash tub of a dishwasher during a wash cycle. In some embodiments, the tubular spray element may be operably coupled to such a drive through a support arrangement that both rotates the tubular spray element and supplies fluid to the tubular spray element, as will become more apparent below. Further details regarding tubular spray elements may be found, for example, in U.S. Pat. No. 10,531,781 to Digman et al., which is assigned to the same assignee as that of the present application, and which is incorporated by reference herein. In other embodiments, however, a tubular spray element may rotate in a less controlled fashion, e.g., through the use of an electric drive, a hydraulic drive, or based upon a force generated in reaction to the ejection of wash fluid from the tubular spray element itself. In such instances, the rotational position of a tubular spray element may not be discretely controlled and/or known at any given time, although other aspects of the rotation or operation of the tubular spray element may still be controlled in some embodiments, e.g., the speed of rotation, whether rotation is enabled or disabled, and/or whether fluid flow is provided to the tubular spray element, etc.

Dishwasher

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position illustrated in FIG. 1 and a closed position (not shown). When door 12 is in the opened position, access is provided to one or more sliding racks, e.g., lower rack 18 and upper rack 20, within which various utensils are placed for washing. Lower rack 18 may be supported on rollers 22, while upper rack 20 may be supported on side rails 24, and each rack is movable between loading (extended) and washing (retracted) positions along a substantially horizontal direction. Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle.

In addition, consistent with some embodiments of the invention, dishwasher 10 may include one or more tubular spray elements (TSEs) 26 to direct a wash fluid onto utensils disposed in racks 18, 20. As will become more apparent below, tubular spray elements 26 are rotatable about respective longitudinal axes and are discretely directable by one or more tubular spray element drives (not shown in FIG. 1) to control a direction at which fluid is sprayed by each of the tubular spray elements. In some embodiments, fluid may be dispensed solely through tubular spray elements, however the invention is not so limited. For example, in some embodiments various upper and/or lower rotating spray arms may also be provided to direct additional fluid onto utensils. Still other sprayers, including various combinations of wall-mounted sprayers, rack-mounted sprayers, oscillating sprayers, fixed sprayers, rotating sprayers, focused sprayers, etc., may also be combined with one or more tubular spray elements in some embodiments of the invention.

Some tubular spray elements 26 may be fixedly mounted to a wall or other structure in wash tub 16, e.g., as may be the case for tubular spray elements 26 disposed below or adjacent lower rack 18. For other tubular spray elements 26, e.g., rack-mounted tubular spray elements, the tubular spray elements may be removably coupled to a docking arrangement such as docking arrangement 28 mounted to the rear wall of wash tub 16 in FIG. 1.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers or dish sink dishwashers, e.g., a dishwasher integrated into a sink.

Figure 2:
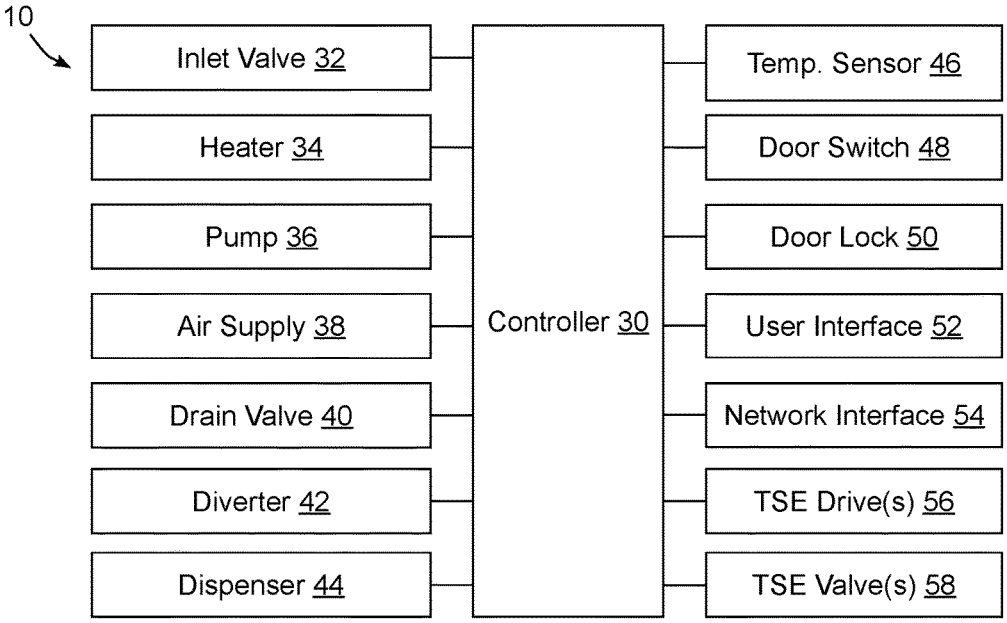
FIG. 2 is a block diagram of an example control system for the dishwasher of FIG. 1.

Now turning to FIG. 2, dishwasher 10 may be under the control of a controller 30 that receives inputs from a number of components and drives a number of components in response thereto. Controller 30 may, for example, include one or more processors and a memory (not shown) within which may be stored program code for execution by the one or more processors. The memory may be embedded in controller 30, but may also be considered to include volatile and/or non-volatile memories, cache memories, flash memories, programmable read-only memories, read-only memories, etc., as well as memory storage physically located elsewhere from controller 30, e.g., in a mass storage device or on a remote computer interfaced with controller 30.

As shown in FIG. 2, controller 30 may be interfaced with various components, including an inlet valve 32 that is coupled to a water source to introduce water into wash tub 16, which when combined with detergent, rinse agent and/or other additives, forms various wash fluids. Controller may also be coupled to a heater 34 that heats fluids, a pump 36 that recirculates wash fluid within the wash tub by pumping fluid to the wash arms and other spray devices in the dishwasher, an air supply 38 that provides a source of pressurized air for use in drying utensils in the dishwasher, a drain valve 40 that is coupled to a drain to direct fluids out of the dishwasher, and a diverter 42 that controls the routing of pumped fluid to different tubular spray elements, spray arms and/or other sprayers during a wash cycle. In some embodiments, a single pump 36 may be used, and drain valve 40 may be configured to direct pumped fluid either to a drain or to the diverter 42 such that pump 36 is used both to drain fluid from the dishwasher and to recirculate fluid throughout the dishwasher during a wash cycle. In other embodiments, separate pumps may be used for draining the dishwasher and recirculating fluid. Diverter 42 in some embodiments may be a passive diverter that automatically sequences between different outlets, while in some embodiments diverter 42 may be a powered diverter that is controllable to route fluid to specific outlets on demand. In still other embodiments, and as will be discussed in greater detail below, each tubular spray element may be separately controlled such that no separate diverter is used. Air supply 38 may be implemented as an air pump or fan in different embodiments, and may include a heater and/or other air conditioning device to control the temperature and/or humidity of the pressurized air output by the air supply.

In the illustrated embodiment, pump 36 and air supply 38 collectively implement a fluid supply for dishwasher 100, providing both a source of wash fluid and pressurized air for use respectively during wash and drying operations of a wash cycle. A wash fluid may be considered to be a fluid, generally a liquid, incorporating at least water, and in some instances, additional components such as detergent, rinse aid, and other additives. During a rinse operation, for example, the wash fluid may include only water. A wash fluid may also include steam in some instances. Pressurized air is generally used in drying operations, and may or may not be heated and/or dehumidified prior to spraying into a wash tub. It will be appreciated, however, that pressurized air may not be used for drying purposes in some embodiments, so air supply 38 may be omitted in some instances. Moreover, in some instances, tubular spray elements may be used solely for spraying wash fluid or spraying pressurized air, with other sprayers or spray arms used for other purposes, so the invention is not limited to the use of tubular spray elements for spraying both wash fluid and pressurized air.

Controller 30 may also be coupled to a dispenser 44 to trigger the dispensing of detergent and/or rinse agent into the wash tub at appropriate points during a wash cycle. Additional sensors and actuators may also be used in some embodiments, including a temperature sensor 46 to determine a wash fluid temperature, a door switch 48 to determine when door 12 is latched, and a door lock 50 to prevent the door from being opened during a wash cycle. Moreover, controller 30 may be coupled to a user interface 52 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 30 may also be coupled to one or more network interfaces 54, e.g., for interfacing with external devices via wired and/or wireless networks such as Ethernet, Bluetooth, NFC, cellular and other suitable networks. Additional components may also be interfaced with controller 30, as will be appreciated by those of ordinary skill having the benefit of the instant disclosure. For example, one or more tubular spray element (TSE) drives 56 and/or one or more tubular spray element (TSE) valves 58 may be provided in some embodiments to discretely control one or more tubular spray elements disposed in dishwasher 10, as will be discussed in greater detail below.

It will be appreciated that each tubular spray element drive 56 may also provide feedback to controller 30 in some embodiments, e.g., a current position and/or speed, although in other embodiments a separate position sensor may be used. In addition, as will become more apparent below, flow regulation to a tubular spray element may be performed without the use of a separately-controlled tubular spray element valve 58 in some embodiments, e.g., where rotation of a tubular spray element by a tubular spray element drive is used to actuate a mechanical valve.

Moreover, in some embodiments, at least a portion of controller 30 may be implemented externally from a dishwasher, e.g., within a mobile device, a cloud computing environment, etc., such that at least a portion of the functionality described herein is implemented within the portion of the controller that is externally implemented. In some embodiments, controller 30 may operate under the control of an operating system and may execute or otherwise rely upon various computer software applications, components, programs, objects, modules, data structures, etc. In addition, controller 30 may also incorporate hardware logic to implement some or all of the functionality disclosed herein. Further, in some embodiments, the sequences of operations performed by controller 30 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the dishwasher illustrated in FIGS. 1-2 will be apparent to one of ordinary skill in the art, as will become apparent from the description below. Therefore, the invention is not limited to the specific implementations discussed herein.

Tubular Spray Elements

Figure 3:
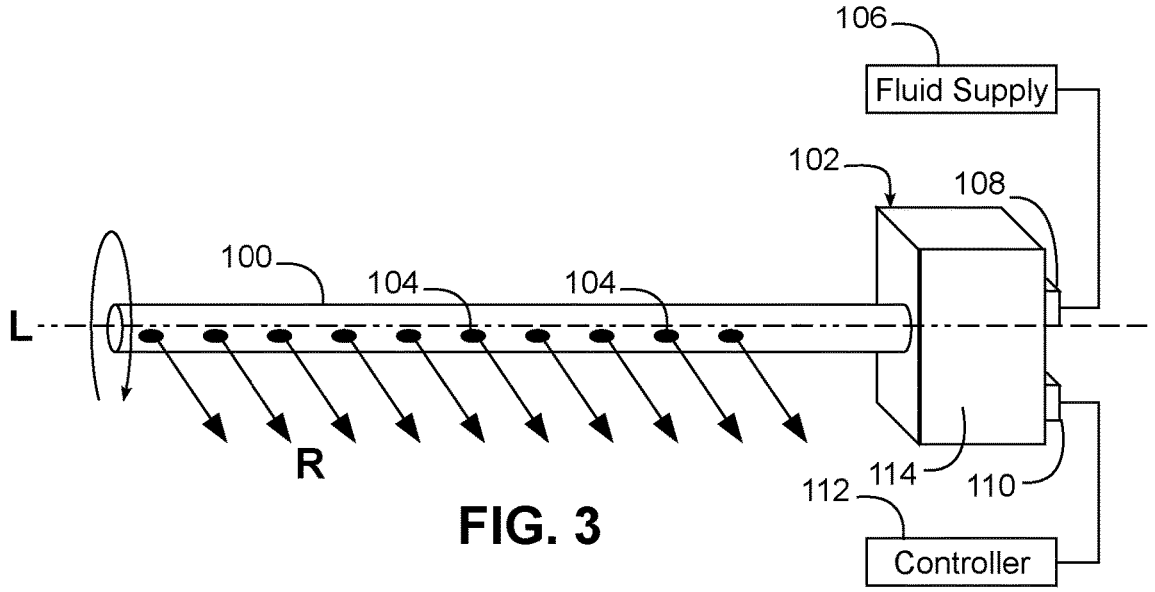
FIG. 3 is a side perspective view of a tubular spray element and tubular spray element drive from the dishwasher of FIG. 1.

Now turning to FIG. 3, in some embodiments, a dishwasher may include one or more discretely directable tubular spray elements, e.g., tubular spray element 100 coupled to a tubular spray element drive 102. Tubular spray element 100 may be configured as a tube or other elongated body disposed in a wash tub and being rotatable about a longitudinal axis L. In addition, tubular spray element 100 is generally hollow or at least includes one or more internal fluid passages that are in fluid communication with one or more apertures 104 extending through an exterior surface thereof. Each aperture 104 may function to direct a spray of fluid into the wash tub, and each aperture may be configured in various manners to provide various types of spray patterns, e.g., streams, fan sprays, concentrated sprays, etc. Apertures 104 may also in some instances be configured as fluidic nozzles providing oscillating spray patterns.

Moreover, as illustrated in FIG. 3, apertures 104 may all be positioned to direct fluid along a same radial direction from axis L, thereby focusing all fluid spray in generally the same radial direction represented by arrows R. In other embodiments, however, apertures may be arranged differently about the exterior surface of a tubular spray element, e.g., to provide spray from two, three or more radial directions, to distribute a spray over one or more arcs about the circumference of the tubular spray element, etc.

Tubular spray element 100 is in fluid communication with a fluid supply 106, e.g., through a port 108 of tubular spray element drive 102, to direct fluid from the fluid supply into the wash tub through the one or more apertures 104. Tubular spray element drive 102 is coupled to tubular spray element 100 and is configured to discretely direct the tubular spray element 100 to each of a plurality of rotational positions about longitudinal axis L. By "discretely directing," what is meant is that tubular spray element drive 102 is capable of rotating tubular spray element 100 generally to a controlled rotational angle (or at least within a range of rotational angles) about longitudinal axis L. Thus, rather than uncontrollably rotating tubular spray element 100 or uncontrollably oscillating the tubular spray element between two fixed rotational positions, tubular spray element drive 102 is capable of intelligently focusing the spray from tubular spray element 100 between multiple rotational positions. It will also be appreciated that rotating a tubular spray element to a controlled rotational angle may refer to an absolute rotational angle (e.g., about 10 degrees from a home position) or may refer to a relative rotational angle (e.g., about 10 degrees from the current position).

Tubular spray element drive 102 is also illustrated with an electrical connection 110 for coupling to a controller 112, and a housing 114 is illustrated for housing various components in tubular spray element drive 102 that will be discussed in greater detail below. In the illustrated embodiment, tubular spray element drive 102 is configured as a base that supports, through a rotary coupling, an end of the tubular spray element and effectively places the tubular spray element in fluid communication with port 108.

By having an intelligent control provided by tubular spray element drive 102 and/or controller 112, spray patterns and cycle parameters may be increased and optimized for different situations. For instance, tubular spray elements near the center of a wash tub may be configured to rotate 360 degrees, while tubular spray elements located near wash tub walls may be limited to about 180 degrees of rotation to avoid spraying directly onto any of the walls of the wash tub, which can be a significant source of noise in a dishwasher. In another instance, it may be desirable to direct or focus a tubular spray element to a fixed rotational position or over a small range of rotational positions (e.g., about 5-10 degrees) to provide concentrated spray of liquid, steam and/or air, e.g., for cleaning silverware or baked on debris in a pan. In addition, in some instances the rotational velocity of a tubular spray element could be varied throughout rotation to provide longer durations in certain ranges of rotational positions and thus provide more concentrated washing in particular areas of a wash tub, while still maintaining rotation through 360 degrees. Control over a tubular spray element may include control over rotational position, speed or rate of rotation and/or direction of rotation in different embodiments of the invention.

Figure 4:
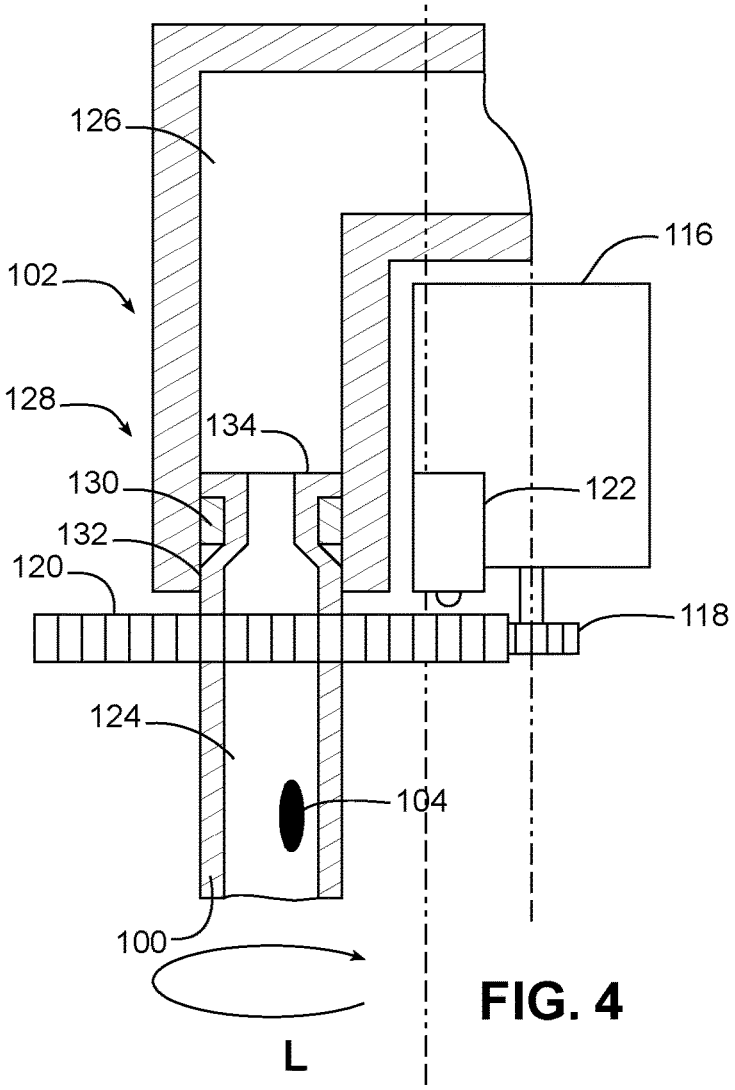
FIG. 4 is a partial cross-sectional view of the tubular spray element and tubular spray element drive of FIG. 3.

FIG. 4 illustrates one example implementation of tubular spray element 100 and tubular spray element drive 102 in greater detail, with housing 114 omitted for clarity. In this implementation, tubular spray element drive 102 includes an electric motor 116, which may be an alternating current (AC) or direct current (DC) motor, e.g., a brushless DC motor, a stepper motor, etc., which is mechanically coupled to tubular spray element 100 through a gearbox including a pair of gears 118, 120 respectively coupled to motor 116 and tubular spray element 100. Other manners of mechanically coupling motor 116 to tubular spray element 100 may be used in other embodiments, e.g., different numbers and/or types of gears, belt and pully drives, magnetic drives, hydraulic drives, linkages, friction, etc.

In addition, an optional position sensor 122 may be disposed in tubular spray element drive 102 to determine a rotational position of tubular spray element 100 about axis L. Position sensor 122 may be an encoder or hall sensor in some embodiments, or may be implemented in other manners, e.g., integrated into a stepper motor, whereby the rotational position of the motor is used to determine the rotational position of the tubular spray element. Position sensor 122 may also sense only limited rotational positions about axis L (e.g., a home position, 30 or 45 degree increments, etc.). Further, in some embodiments, rotational position may be controlled using time and programming logic, e.g., relative to a home position, and in some instances without feedback from a motor or position sensor. Position sensor 122 may also be external to tubular spray element drive 102 in some embodiments.

An internal passage 124 in tubular spray element 100 is in fluid communication with an internal passage 126 leading to port 108 (not shown in FIG. 4) in tubular spray element drive 102 through a rotary coupling 128. In one example implementation, coupling 128 is formed by a bearing 130 mounted in passageway 126, with one or more deformable tabs 134 disposed at the end of tubular spray element 100 to secure tubular spray element 100 to tubular spray element drive 102. A seal 132, e.g., a lip seal, may also be formed between tubular spray element 100 and tubular spray element drive 102. Other manners of rotatably coupling the tubular spray element while providing fluid flow may be used in other embodiments.

Figure 5:
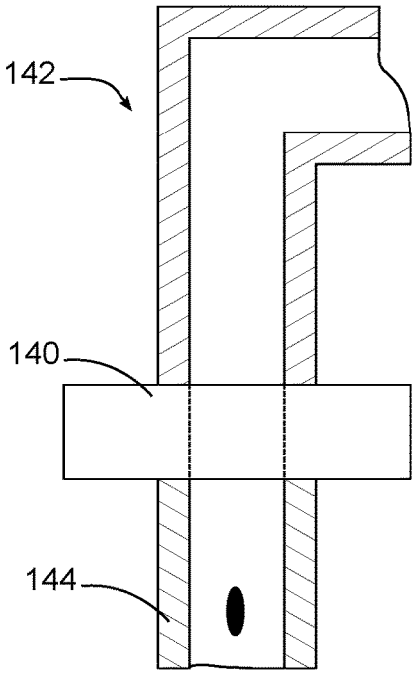
FIG. 5 is a partial cross-sectional view of another tubular spray element and tubular spray element drive consistent with some embodiments of the invention, and including a valve for restricting flow to the tubular spray element.

Turning to FIG. 5, it also may be desirable in some embodiments to incorporate a valve 140 into a tubular spray element drive 142 to regulate the fluid flow to a tubular spray element 144 (other elements of drive 142 have been omitted from FIG. 5 for clarity). Valve 140 may be an on/off valve in some embodiments or may be a variable valve to control flow rate in other embodiments. In still other embodiments, a valve may be external to or otherwise separate from a tubular spray element drive, and may either be dedicated to the tubular spray element or used to control multiple tubular spray elements. Valve 140 may be integrated with or otherwise proximate a rotary coupling between tubular spray element 144 and tubular spray element drive 142. By regulating fluid flow to tubular spray elements, e.g., by selectively shutting off tubular spray elements, water can be conserved and/or high-pressure zones can be created by pushing all of the hydraulic power through fewer numbers of tubular spray elements.

In some embodiments, valve 140 may be actuated independent of rotation of tubular spray element 144, e.g., using an iris valve, butterfly valve, gate valve, plunger valve, piston valve, valve with a rotatable disc, ball valve, etc., and actuated by a solenoid, motor or other separate mechanism from the mechanism that rotates tubular spray element 144. In other embodiments, however, valve 140 may be actuated through rotation of tubular spray element 144. In some embodiments, for example, rotation of tubular spray element 144 to a predetermined rotational position may close valve 140, e.g., where valve 140 includes an arcuate channel that permits fluid flow over only a range of rotational positions. In other embodiments, a valve may be actuated through over-rotation of a tubular spray element, or through counter rotation of a tubular spray element. Further, in some embodiments, a valve may be variable, e.g., configured as an iris valve, to regulate fluid flow to the tubular spray element, and may be independently actuated from rotation of a tubular spray element in some embodiments (e.g., via a solenoid or motor), or may be actuated through rotation of a tubular spray element, e.g., through rotation to a predetermined position, an over-rotation, or a counter-rotation, using appropriate mechanical linkages. Other variations will be appreciated by those of ordinary skill having the benefit of the instant disclosure.

Figure 6:
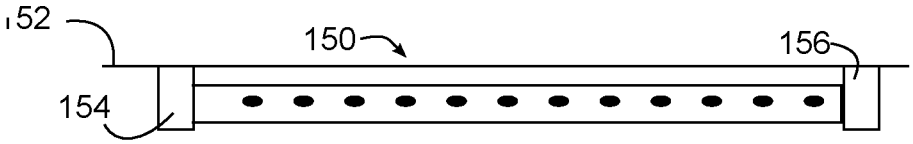
FIG. 6 is a functional top plan view of an example implementation of a wall-mounted tubular spray element and tubular spray element drive consistent with some embodiments of the invention.
Figure 7:
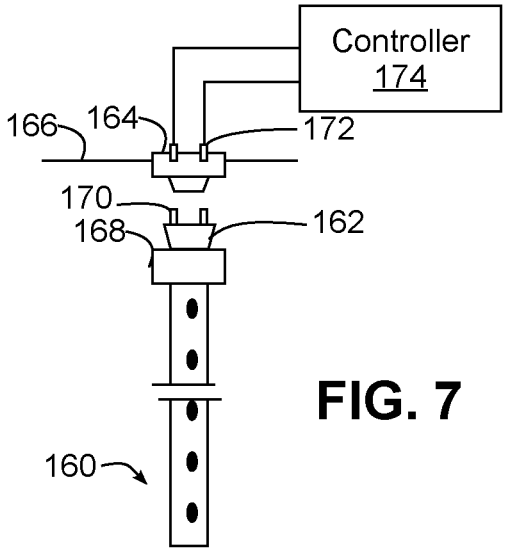
FIG. 7 is a functional top plan view of an example implementation of a rack-mounted tubular spray element and tubular spray element drive consistent with some embodiments of the invention.
Figure 8:
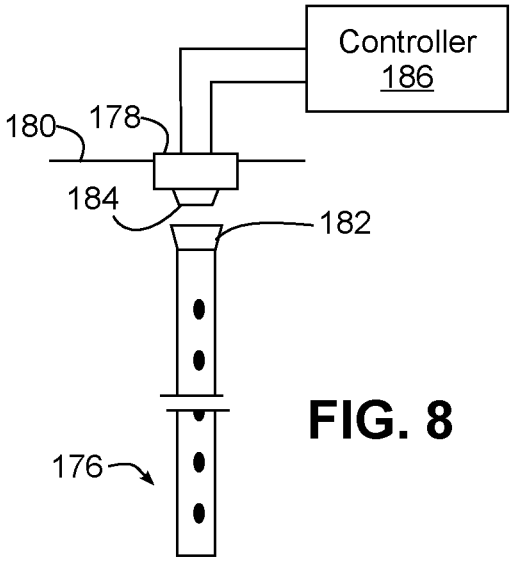
FIG. 8 is a functional top plan view of another example implementation of a rack-mounted tubular spray element and tubular spray element drive consistent with some embodiments of the invention.

Now turning to FIGS. 6-8, tubular spray elements may be mounted within a wash tub in various manners in different embodiments. As illustrated by FIGS. 1 and 3 (discussed above), a tubular spray element in some embodiments may be mounted to a wall (e.g., a side wall, a back wall, a top wall, a bottom wall, or a door) of a wash tub, and may be oriented in various directions, e.g., horizontally, vertically, front-to-back, side-to-side, or at an angle. It will also be appreciated that a tubular spray element drive may be disposed within a wash tub, e.g., mounted on wall of the wash tub or on a rack or other supporting structure, or alternatively some or all of the tubular spray element drive may be disposed external from a wash tub, e.g., such that a portion of the tubular spray element drive or the tubular spray element projects through an aperture in the wash tub. Alternatively, a magnetic drive could be used to drive a tubular spray element in the wash tub using an externally-mounted tubular spray element drive.

Moreover, as illustrated by tubular spray element 150 of FIG. 6, rather than being mounted in a cantilevered fashion as is the case with tubular spray element 100 of FIG. 3, a tubular spray element may also be mounted on a wall 152 of a wash tub and supported at both ends by hubs 154, 156, one or both of which may include the components of the tubular spray element drive. In this regard, the tubular spray element 150 runs generally parallel to wall 152 rather than running generally perpendicular thereto, as is the case with tubular spray element 100 of FIG. 3.

In still other embodiments, a tubular spray element may be rack-mounted. FIG. 7, for example, illustrates a tubular spray element 160 mountable on rack (not shown) and dockable via a dock 162 to a docking port 164 on a wall 166 of a wash tub. In this embodiment, a tubular spray element drive 168 is also rack-mounted, and as such, in addition to a fluid coupling between dock 162 and docking port 164, a plurality of cooperative contacts 170, 172 are provided on dock 162 and docking port 164 to provide power to tubular spray element drive 168 as well as electrical communication with a controller 174.

As an alternative, and as illustrated in FIG. 8, a tubular spray element 176 may be rack-mounted, but separate from a tubular spray element drive 178 that is not rack-mounted, but is instead mounted to a wall 180 of a wash tub. A dock 182 and docking port 184 provide fluid communication with tubular spray element 176, along with a capability to rotate tubular spray element 176 about its longitudinal axis under the control of tubular spray element drive 178. Control over tubular spray element drive 178 is provided by a controller 186. In some instances, tubular spray element drive 178 may include a rotatable and keyed channel into which an end of a tubular spray element may be received.

Figure 9:
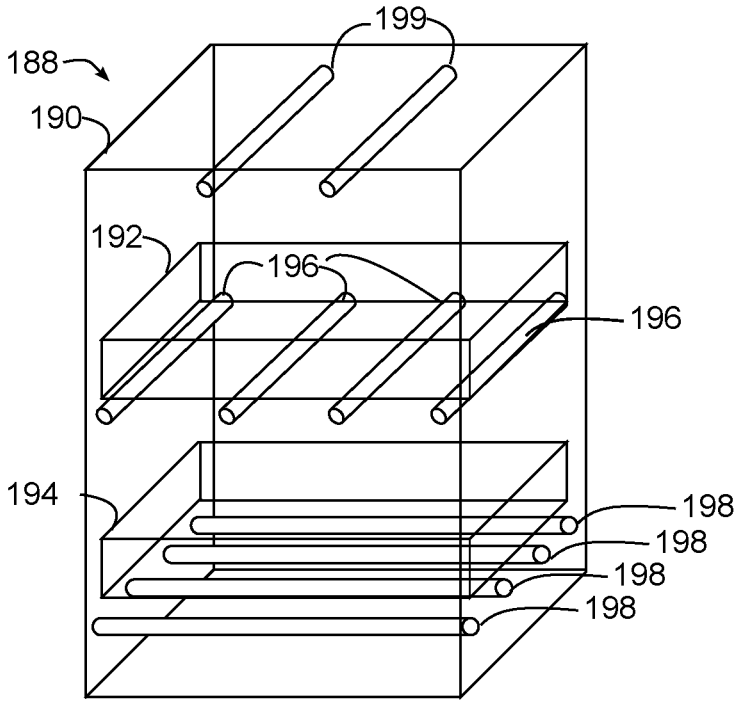
FIG. 9 is a functional perspective view of a dishwasher incorporating multiple tubular spray elements and consistent with some embodiments of the invention.

FIG. 9 next illustrates a dishwasher 188 including a wash tub 190 and upper and lower racks 192, 194, and with a number of tubular spray elements 196, 198, 199 distributed throughout the wash tub 190 for circulating a wash fluid through the dishwasher. Tubular spray elements 196 may be rack-mounted, supported on the underside of upper rack 192, and extending back-to-front within wash tub 190. Tubular spray elements 196 may also dock with back wall-mounted tubular spray element drives (not shown in FIG. 9), e.g., as discussed above in connection with FIG. 8. In addition, tubular spray elements 196 may be rotatably supported at one or more points along their respective longitudinal axes by couplings (not shown) suspended from upper rack 192. Tubular spray elements 196 may therefore spray upwardly into upper rack 192 and/or downwardly onto lower rack 194, and in some embodiments, may be used to focus wash fluid onto a silverware basket or other region of either rack to provide for concentrated washing. Tubular spray elements 198 may be wall-mounted beneath lower rack 194, and may be supported at both ends on the side walls of wash tub 190 to extend in a side-to-side fashion, and generally transverse to tubular spray elements 196. Each tubular spray element 196, 198 may have a separate tubular spray element drive in some embodiments, while in other embodiments some or all of the tubular spray elements 196, 198 may be mechanically linked and driven by common tubular spray element drives.

In some embodiments, tubular spray elements 196, 198 by themselves may provide sufficient washing action and coverage. In other embodiments, however, additional tubular spray elements, e.g., tubular spray elements 199 supported above upper rack 192 on one or both of the top and back walls of wash tub 190, may also be used. In addition, in some embodiments, additional spray arms and/or other sprayers may be used. It will also be appreciated that while 10 tubular spray elements are illustrated in FIG. 9, greater or fewer numbers of tubular spray elements may be used in other embodiments.

It will also be appreciated that in some embodiments, multiple tubular spray elements may be driven by the same tubular spray element drive, e.g., using geared arrangements, belt drives, or other mechanical couplings. Further, tubular spray elements may also be movable in various directions in addition to rotating about their longitudinal axes, e.g., to move transversely to a longitudinally axis, to rotate about an axis of rotation that is transverse to a longitudinal axis, etc. In addition, deflectors may be used in combination with tubular spray elements in some embodiments to further the spread of fluid and/or prevent fluid from hitting tub walls. In some embodiments, deflectors may be integrated into a rack, while in other embodiments, deflectors may be mounted to a wall of the wash tub. In addition, deflectors may also be movable in some embodiments, e.g., to redirect fluid between multiple directions. Moreover, while in some embodiments tubular spray elements may be used solely to spray wash fluid, in other embodiments tubular spray elements may be used to spray pressurized air at utensils during a drying operation of a wash cycle, e.g., to blow off water that pools on cups and dishes after rinsing is complete. In some instances, different tubular spray elements may be used to spray wash fluid and spray pressurized air, while in other instances the same tubular spray elements may be used to alternately or concurrently spray wash liquid and pressurized air.

Tubular Spray Element with Multiple Selectable Spray Patterns

In some embodiments consistent with the invention, a tubular spray element may support multiple spray patterns that differ from one another, and that direct wash fluid from different subsets of apertures in the tubular spray element. An aperture, in this regard, may be considered to be any passageway through a structure that allows for fluid flow, and as will become more apparent below, in some embodiments some apertures may be internal to a tubular spray element such that they may be selectively aligned with other apertures in an exterior surface of the tubular spray element to allow for fluid flow from an internal passageway of the tubular spray element and out of the aligned apertures to direct a spray of wash fluid into the wash tub of a dishwasher, e.g., to spray wash fluid onto one or more utensils disposed within the wash tub. Apertures may be configured as holes or voids in some embodiments, while in other embodiments apertures may include structures used to control the direction, velocity, volume and/or dispersion of fluid, e.g., to provide different types of sprays such as jets, streams, soaks, mists, etc. Furthermore, combinations of apertures may be used to provide various spray patterns such as focused or narrow sprays, wide or dispersed sprays, as well as spray patterns that focus on particular regions of a wash tub (e.g., to provide high pressure washing of heavily soiled utensils, to wash silverware in a silverware basket, to flood glassware with clean water at the end of a cycle to minimize spotting, etc.). Apertures may also be associated with additional structures such as fluidic nozzles, rotating nozzles, oscillating nozzles, etc. in some embodiments.

Figure 10:
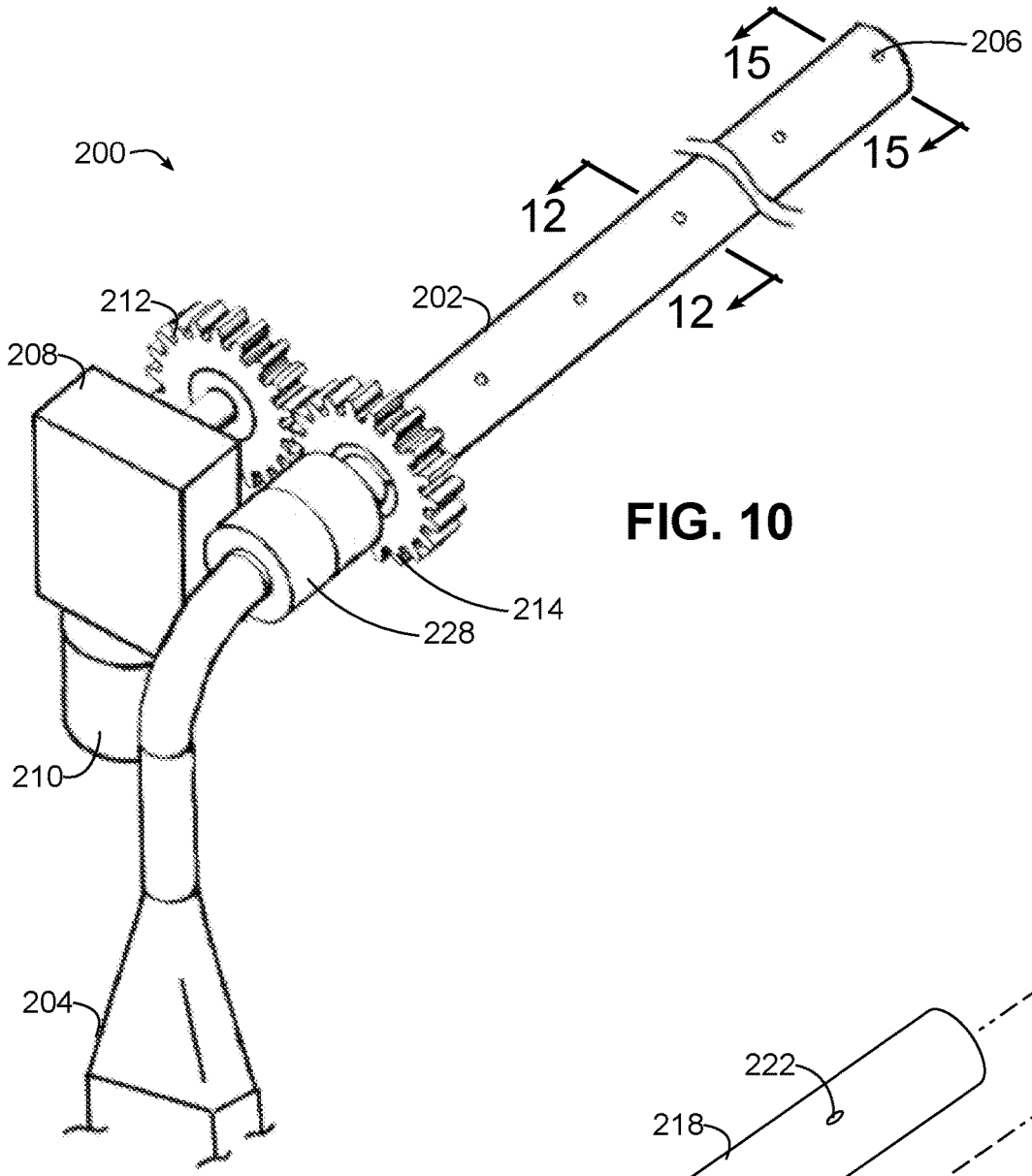
FIG. 10 is a perspective view of an example implementation of a multi-walled tubular spray element spraying system consistent with some embodiments of the invention.

Turning to FIG. 10, one manner of implementing multiple selectable spray patterns in a tubular spray element consistent with the invention is to utilize a multi-wall tubular spray element having concentric wall sections that are movable relative to one another to selectively expose or block different apertures formed on a tubular spray element and thereby implement different spray patterns therewith. In particular, FIG. 10 illustrates a tubular spray element spraying system 200 including a multi-walled tubular spray element 202 in fluid communication with a fluid supply 204 and including a plurality of apertures, at least a portion of which are illustrated as apertures 206 formed on an exterior surface of tubular spray element 202. In the illustrated embodiment, a tubular spray element drive 208, e.g., including a stepper motor 210 and a pair of gears 212, 214, may be used to drive rotation of tubular spray element 202. In some embodiments, tubular spray element 202 may be discretely directable by tubular spray element drive 208, while in other embodiments, tubular spray element 202 may be driven in a non-discrete manner, e.g., such that the direction at which the tubular spray element is directed is not tracked during operation, and is only rotated. In still other embodiments, alternative drives, e.g., hydraulic drives, may be used to control rotation of tubular spray element 202.

Figure 11:
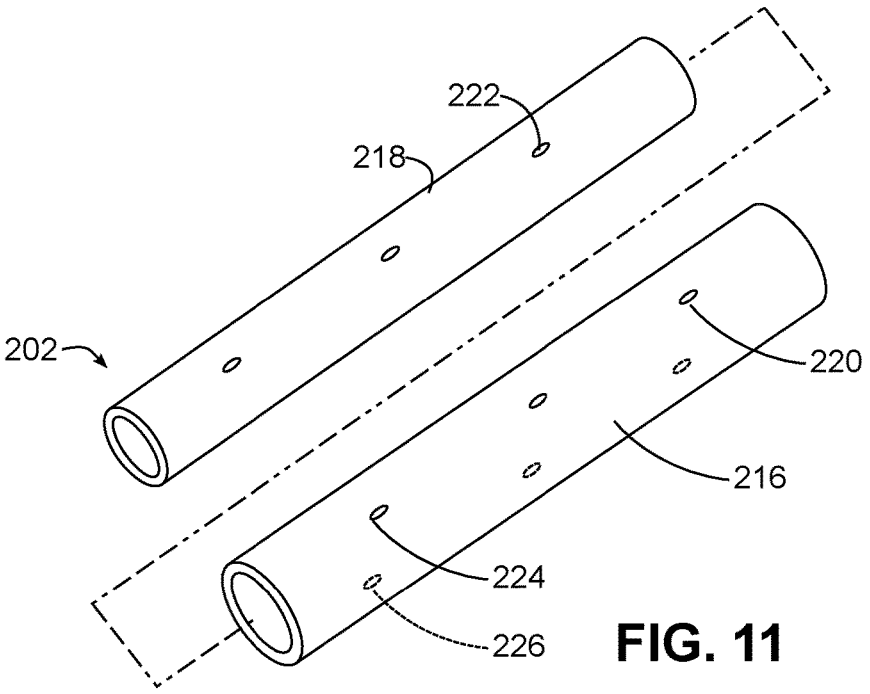
FIG. 11 is an exploded perspective view of the tubular spray element referenced in FIG. 10.

As shown in FIG. 11, in the illustrated embodiment tubular spray element 202 includes a pair of concentric wall sections 216, 218 (also referred to herein as outer and inner wall sections, respectively), each including a respective set of apertures 220, 222. Moreover, in this embodiment, apertures 220 in outer wall section 216 are partitioned into two different subsets of apertures designated at 224, 226, and it should be noted that these different subsets of apertures are angularly offset from one another about the longitudinal axis of the tubular spray element, such that relative rotation of inner wall section 218 within outer wall section 216 is capable of selectively aligning the apertures in set 222 with the apertures in one of subsets 224, 226. It will be appreciated that in other embodiments, the inner wall section 218 may also include multiple subsets of apertures such that different subsets of apertures in inner wall section 218 align with different subsets of apertures in outer wall section 216. Thus, for the purposes of this disclosure, the apertures of inner wall section 218 may be considered to be at least a subset of apertures even if the same apertures in inner wall section 218 are used in multiple positions.

Figure 12:
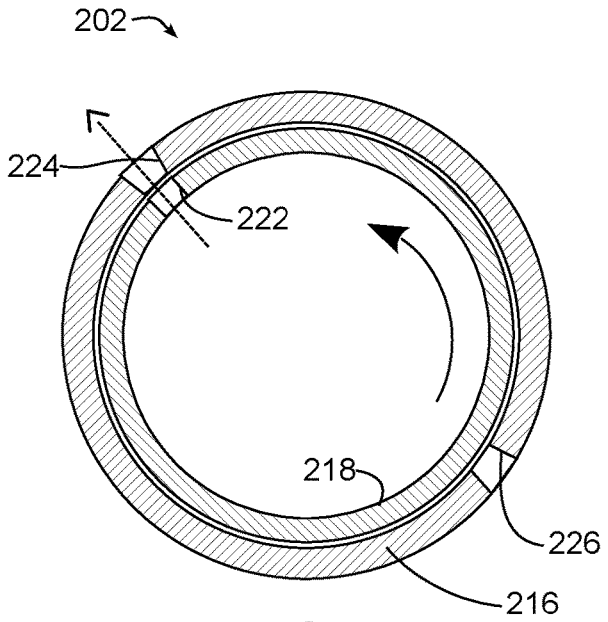
FIG. 12 is a cross-sectional view of the tubular spray element of FIG. 10, taken through lines 12-12 thereof.
Figure 13:
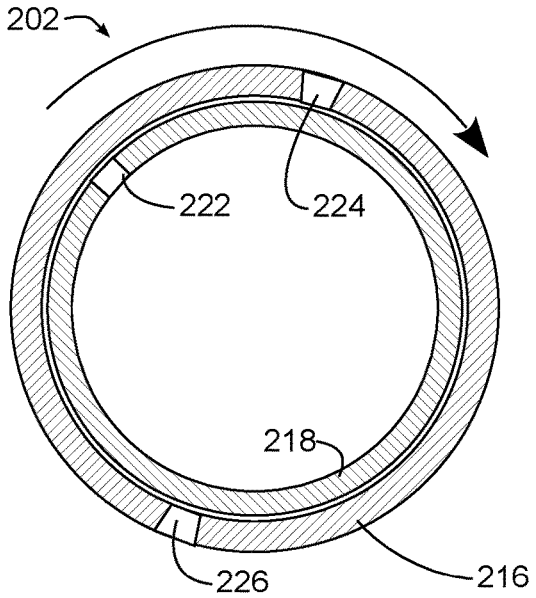
FIGS. 13-14 illustrate the tubular spray element of FIG. 12 at two different rotational positions.
Figure 14:
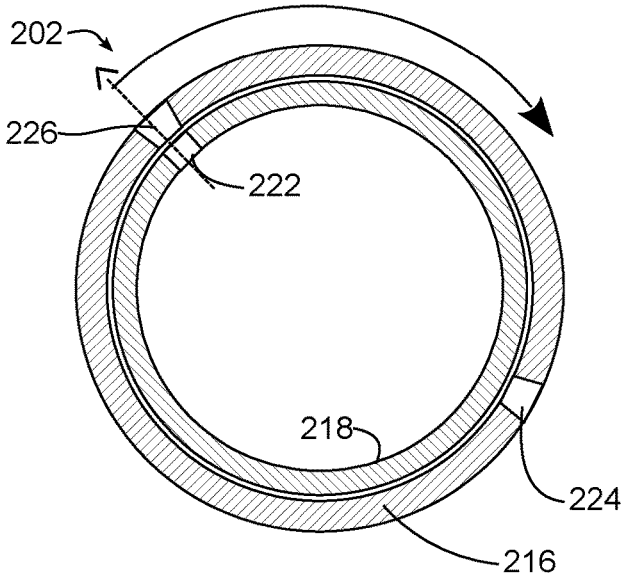

With further reference to FIGS. 12-14, in one position, e.g., as shown in FIG. 12, the apertures in subset 224 may be aligned with the apertures in set 222, thus placing the apertures in subset 224 in fluid communication with fluid supply 204 through the apertures in set 222. At the same time, the apertures in subset 226 will be closed off by wall section 218, and thus no fluid flow will occur through these apertures. Clockwise rotation of wall section 216 relative to wall section 218 as illustrated in FIG. 13, results in none of the apertures in subsets 224, 226 aligning with the apertures in set 222, whereby no fluid flow occurs. Further rotation in the clockwise direction, however, as illustrated in FIG. 14, may result in the apertures in subset 226 aligning with the apertures in set 220, thus placing the apertures in subset 226 in fluid communication with fluid supply 204 through the apertures in set 220, and with the apertures in subset 224 blocked by wall section 218, such that fluid flow occurs through the apertures in subset 226. Furthermore, by configuring the apertures in subsets 224, 226 to collectively emit fluid in different spray patterns, it may be seen that tubular spray element 202 may support different spray patterns through control over the relative rotational positions of wall sections 216, 218.

Control over the relative rotation between wall sections 216, 218 may be provided in a number of manners consistent with the invention. In some embodiments, for example, a separate rotational drive may be used to generate the relative rotation, and in some embodiments, various catches, ratcheting mechanisms and/or biasing mechanisms may be used to index the wall sections between different positions.

In the illustrated embodiment, however, such relative movement may be implemented in part through the use of rotational limits that allow for some rotational movement between the wall sections, but that limit relative rotation beyond those limits. By doing so, selection of different spray patterns may be implemented by changing the direction of rotation of the tubular spray element, such that clockwise rotation of the tubular spray element generates one spray pattern and counter-clockwise rotation generates a different spray pattern. As illustrated in FIG. 10, in some embodiments a frictional coupling 228 may be coupled to the non-driven one of wall sections 216, 218 (e.g., inner wall section 218 in FIG. 10, given that outer wall section 216 is directly driven through gear 214) to overcome any frictional engagement between wall sections 216, 218 and thereby permit relative rotation between the wall sections when wall section 218 is driven by the tubular spray element drive 208.

Figure 15:
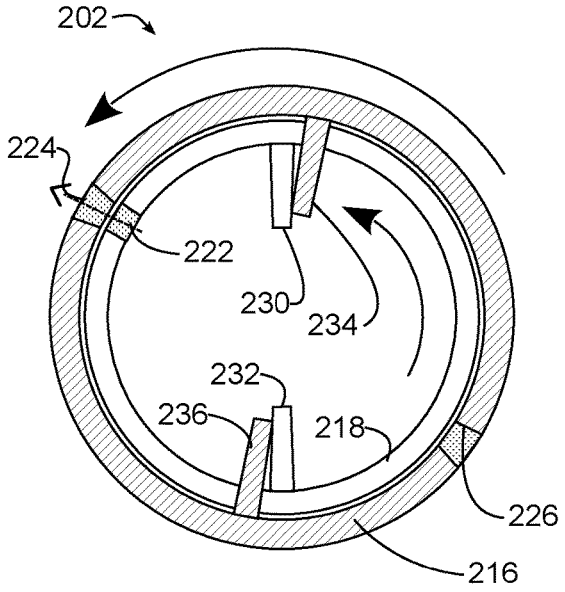
FIG. 15 is a cross-sectional view of the tubular spray element of FIG. 10, taken through lines 15-15 thereof.

Rotational limits may be implemented, for example, as illustrated in FIG. 15-18, whereby a pair of projections 230, 232 coupled to inner wall section 218 are configured to engage a corresponding pair of projections 234, 236 coupled to outer wall section 216. FIG. 15, in particular, corresponds to FIG. 12, and illustrates wall sections 216, 218 in a first position in which the apertures in set 222 are aligned with the apertures in subset 224. As will be appreciated from this figure, projections 230, 232 and projections 234, 236 are in contact with one another such that counter-clockwise rotation of outer wall section 216 will cause a corresponding counter-clockwise rotation of inner wall section 216, thereby maintaining the alignment of the apertures in set 222 with the apertures in subset 224, such that a first spray pattern is emitted so long as rotation continues in the counter-clockwise direction.

Figure 16:
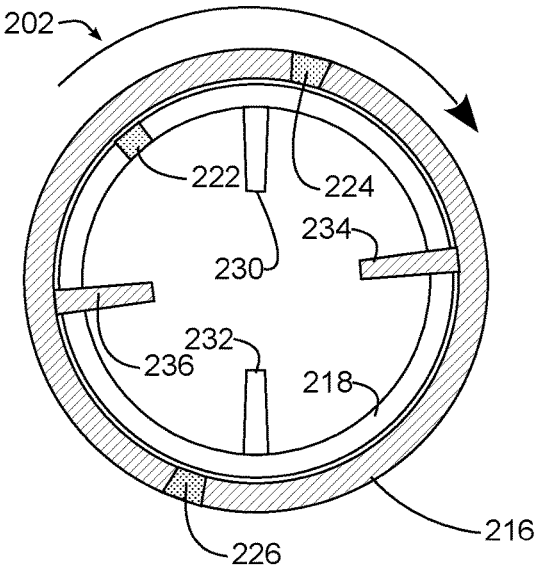
FIGS. 16-18 illustrate the tubular spray element of FIG. 15 at three different rotational positions.
Figure 17:
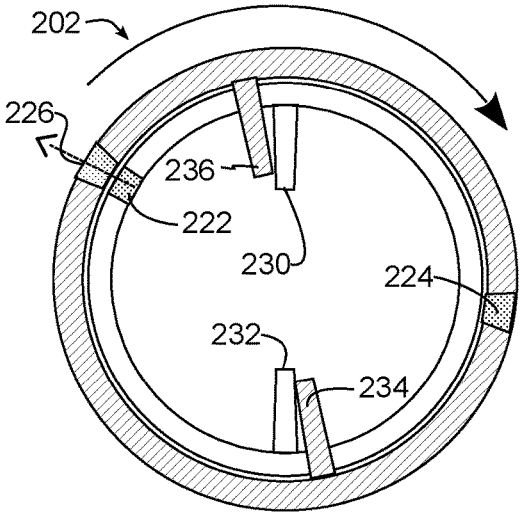
Figure 18:
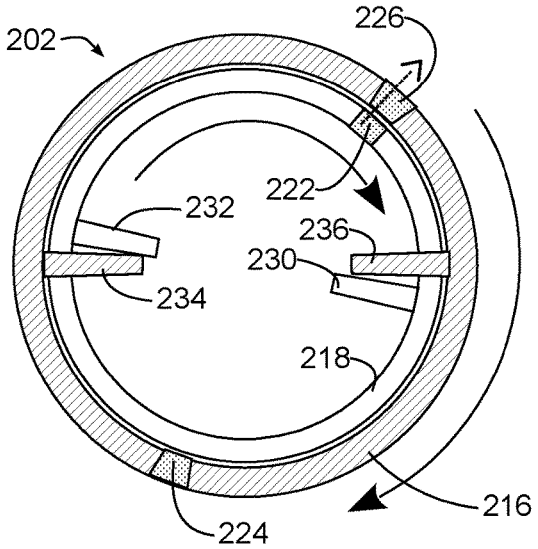

If it is desirable to utilize a second spray pattern, the rotational direction of outer wall section 216 may be reversed, and as illustrated in FIG. 16, relative rotation will occur between wall sections 216, 218 due to the frictional coupling resisting any rotation of inner wall section 218. Then, as illustrated in FIG. 17, once the apertures in set 222 reach a second position in which the apertures are aligned with the apertures in subset 226, projections 230, 232 and projections 234, 236 once again come into contact with one another to limit further relative rotation between the wall sections, and fluid flow is permitted through the apertures in subset 226. Further rotation of outer wall section 216 in the clockwise direction, as illustrated in FIG. 18, will cause a cooperative clockwise rotation of inner wall section 218, maintain the aperture alignment such that the second spray pattern will be emitted so long as rotation continues in the clockwise direction. Thus, by reversing the direction of rotation of the tubular spray element, two different spray patterns may be selected.

Various modifications may be used in different embodiments. For example, more than two subsets of apertures, positions and/or spray patterns may be supported in some embodiments. In addition, in some embodiments, some apertures may span an arc of rotational positions such that fluid flow is maintained when moving between different positions. In one example embodiment, it may be desirable to support narrow and wide spray patterns, and use arcuate apertures that allow for fluid flow in multiple positions for one or more center sprays while having apertures that only allow for fluid flow in one position for one or more end sprays.

Figure 19:
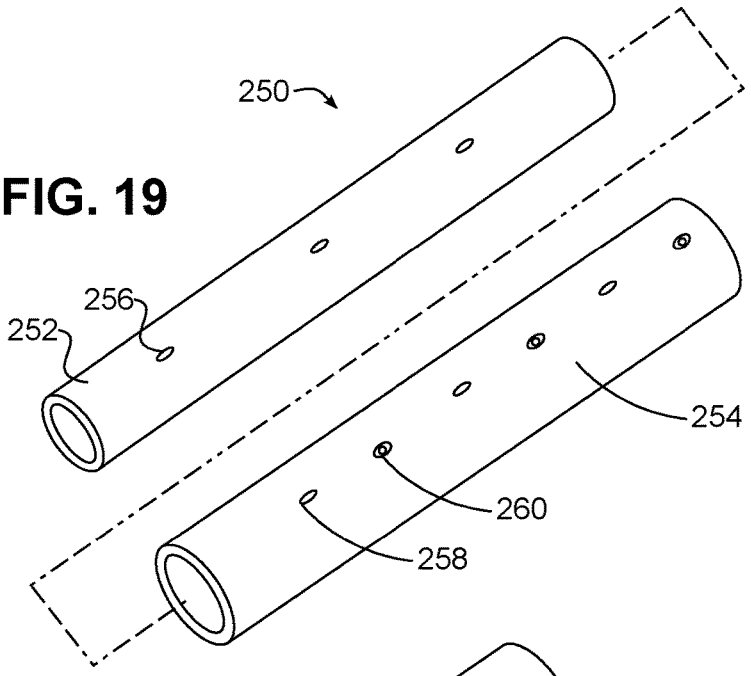
FIG. 19 is an exploded view of another example implementation of a multi-walled tubular spray element consistent with some embodiments of the invention, and including axially movable wall sections.
Figure 20:
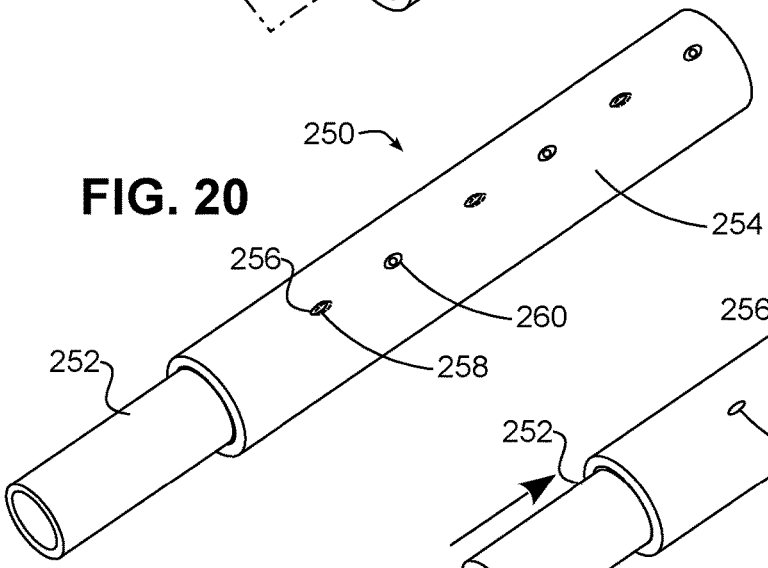
FIGS. 20 and 21 illustrate the tubular spray element of FIG. 19 in respective first and second positions.
Figure 21:
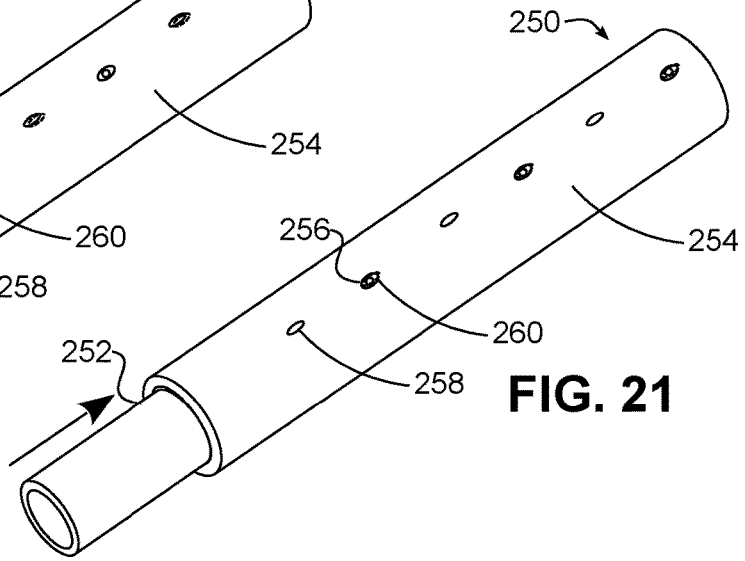

Furthermore, as illustrated in FIG. 19, rather than (or in addition to) rotational movement between multiple wall sections, linear movement along the longitudinal axis may be supported in some embodiments. A tubular spray element 250, for example, may include inner and outer wall sections 252, 254. Inner wall section 252 may include a set 256 of apertures while outer wall section 254 may include two subsets 258, 260 of apertures that are axially offset from one another along the longitudinal axis of the tubular spray element, and that are configured to emit different spray patterns. Thus, through linear movement between inner and outer wall sections 252, 254, the apertures in set 256 may be selectively aligned with either the apertures in subset 258 (as illustrated in FIG. 20) or the apertures in subset 260 (as illustrated in FIG. 21). In some embodiments, a separate tubular spray element spray selector may be used to generate the linear movement, e.g., using a solenoid, linear actuator, hydraulic actuator, electromagnet, cam or other suitable arrangement.

Figure 22:
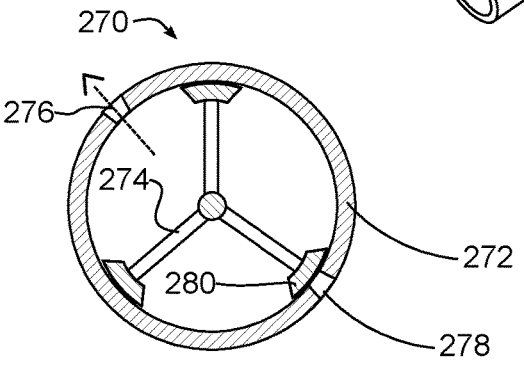
FIG. 22 is a cross-sectional view of yet another example implementation of a multi-walled tubular spray element consistent with some embodiments of the invention, and including partial internal wall sections.

In addition, while the aforementioned embodiments incorporate wall sections that are tubular in shape and thus fully circumscribe the longitudinal axis of the tubular spray element, in other embodiments, the inner or outer wall section may be configured to circumscribe only a portion of the longitudinal axis. FIG. 22, for example, illustrates in cross-section a tubular spray element 270 in which an outer wall section fully circumscribes the longitudinal axis, but the inner wall section 274 includes one or more portions that only partially circumscribe the longitudinal axis. In such a configuration, the portions of the inner wall section operate more to block certain apertures in certain positions, e.g., whereby it is illustrated that fluid flow is permitted through an aperture 276 in outer wall section 272 but restricted through an aperture 278 by virtue of inner wall section 274.

Other modifications and variations of a multi-walled tubular spray element will be appreciated by those of ordinary skill having the benefit of the instant disclosure, so the invention is not limited to the particular embodiments discussed herein.

Figure 23:
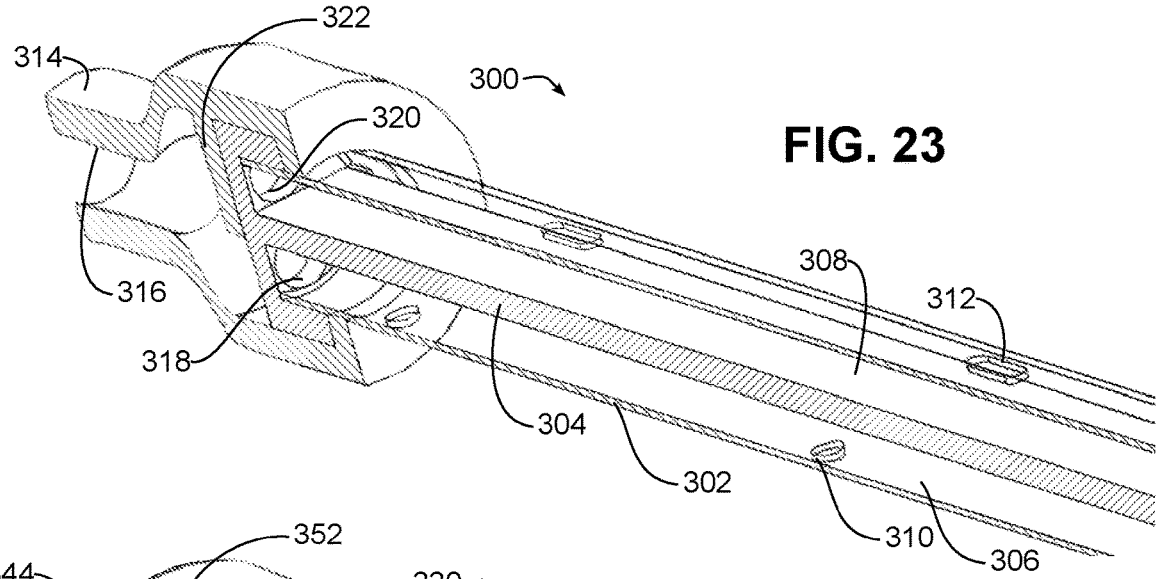
FIG. 23 is a partial perspective cross-sectional view of an example implementation of a multi-chambered tubular spray element consistent with some embodiments of the invention.

Now turning to FIG. 23, instead of a multi-walled tubular spray element, a multi-chambered tubular spray element may be used in some embodiments to support multiple selectable spray patterns. In such embodiments, a plurality of angularly-offset internal chambers may be provided within a tubular spray element, and may extend along the longitudinal axis thereof. A diverter valve coupled intermediate the tubular spray element and the fluid supply may be configured to restrict fluid flow to at least one of the plurality of internal chambers while allowing fluid flow to at least one other of the plurality of internal chambers during rotation of the tubular spray element such that when a first set of apertures is aligned with an internal chamber among the plurality of internal chambers to which fluid flow is allowed and a second set of apertures is aligned with an internal chamber among the plurality of internal chambers to which fluid flow is restricted, wash fluid may be emitted from the first set of apertures in the first selectable spray pattern. Similarly, when the first set of apertures is aligned with an internal chamber among the plurality of internal chambers to which fluid flow is restricted and the second set of apertures is aligned with an internal chamber among the plurality of internal chambers to which fluid flow is allowed, wash fluid may be emitted from the second set of apertures in the second selectable spray pattern.

FIG. 23 illustrates in particular a tubular spay element 300 including a main body 302 forming an outer wall of the tubular spray element, and an internal divider 304 that partitions the interior of the main body 302 into two internal chambers 306, 308. In this embodiment, main body 302 and internal divider 304 are coupled to one another such that they rotate together, and in some embodiments, they may be formed as an integral component.

Two sets of apertures, apertures 310 and apertures 312, are disposed in main body 302 and are respectively in fluid communication with chambers 306, 308 and circumferentially offset from one another. A supply manifold 314 includes an inlet 316 in fluid communication with a fluid supply (not shown in FIG. 23), and internal divider 304 includes a pair of inlets 318, 320, respectively in fluid communication with internal chambers 306, 308, such that fluid flow through inlet 318 directs fluid through apertures 310 while fluid flow through inlet 320 directs fluid through apertures 312.

Supply manifold 314 further includes a diverter valve 322, implemented in the illustrated embodiment as an internal wall that faces internal divider 304, and that restricts fluid flow to whichever of the internal chambers 306, 308 for which its associated inlet 318, 320 faces the internal wall, while allowing fluid flow to the other internal chamber through its associated inlet 318, 320.

As noted above, both main body 302 and internal divider 304 rotate together, and as such, when in the position illustrated in FIG. 23, fluid flow is permitted from inlet 316, through inlet 318, into internal chamber 306, and out of apertures 310, while restricting flow out of apertures 312. A 180 degree rotation of main body 302 and internal divider 304 in turn would expose inlet 320 and allow for fluid flow into internal chamber 308 and out of apertures 312, while restricting flow out of apertures 310. Thus, through rotation of the tubular spray element, different spray patterns may be active at different rotational positions of the tubular spray element. Further, it will be appreciated that the apertures defined in the main body remain aligned with the same internal chambers defined in the tubular spray element throughout the rotation of the tubular spray element. It will also be appreciated that, based on the design of diverter valve 322, the ranges of positions for which fluid flow to a particular internal chamber may be varied, and in some instances, fluid flow to multiple internal chambers may be supported.

Figure 24:
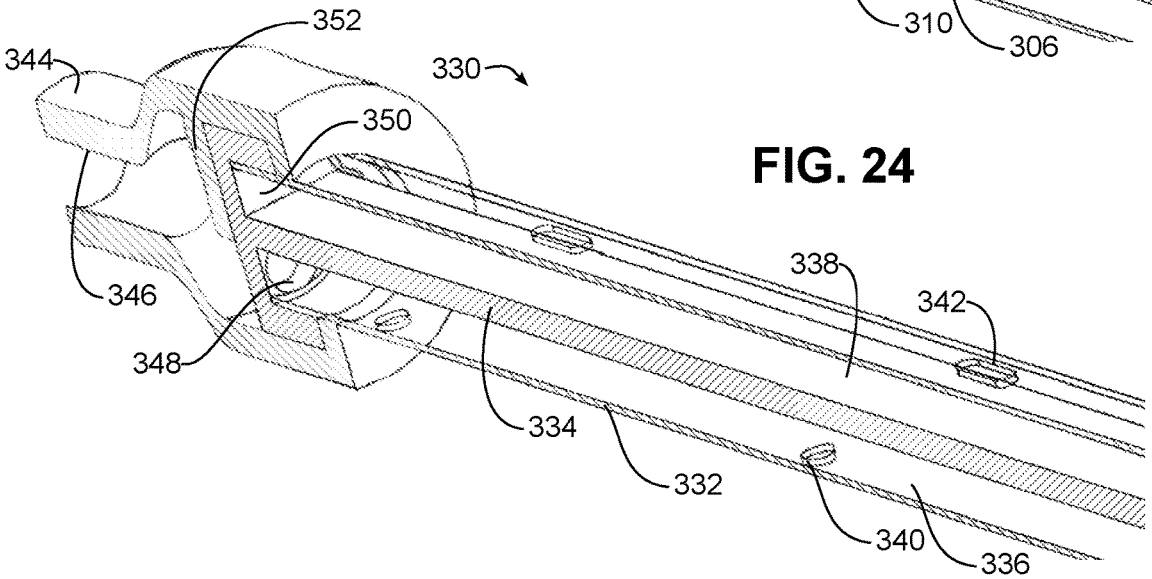
FIG. 24 is a partial perspective cross-sectional view of another example implementation of a multi-chambered tubular spray element consistent with some embodiments of the invention, and including a non-rotatable internal divider.

In other embodiments, and as illustrated by tubular spray element 330 of FIG. 24, a main body 332 may rotate separately from an internal partition 334, such that at different rotational positions of main body 332, internal chambers 336, 338 defined by internal partition 334 may be aligned with different sets of apertures (e.g., apertures 340, 342. Similar to tubular spray element 300, a supply manifold 344 may include an inlet 346, while internal partition 334 may include only a single inlet 348 providing fluid flow to internal chamber 336, with a solid wall 350 facing a diverter valve 352 rather than an inlet to restrict fluid flow to internal chamber 338 at all times.

In this embodiment, main body 332 rotates relative to internal partition 334, and moreover, internal partition 334 is maintained at a fixed rotational position relative to diverter valve 352 such that fluid flow through inlet 348 and into internal chamber 336 is always permitted while fluid flow to internal chamber 338 is always restricted. Thus, in this embodiment, as main body 332 rotates, apertures 340, 342 will align with each of internal chambers 336, 338 at different rotational positions. It will be appreciated that in other embodiments, internal partition 334 may also rotate relative to diverter valve 352, such that control over fluid flow to each internal chamber may be controlled independently of the rotation of the tubular spray element, thereby providing control over spray patterns independent of rotation.

Figure 25:
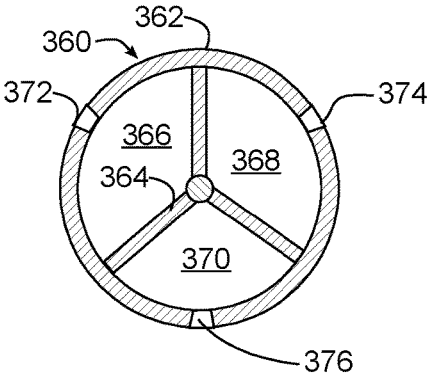
FIG. 25 is a cross-sectional view of yet another example implementation of a multi-chambered tubular spray element consistent with some embodiments of the invention, and including more than two internal chambers.

Further, while the embodiments of FIGS. 23-24 illustrate two sets of apertures and two internal chambers, the invention is not so limited, as more than two sets of apertures and/or more than two internal chambers may be used in some embodiments. FIG. 25, for example, illustrates a tubular spray element 360 having a main body 362 and an internal partition 364 that partitions the tubular spray element into three internal chambers 366, 368, 370. Three associated sets of apertures 372, 374, 376 are also illustrated, whereby support for more than two spray patterns may be provided.

It will also be appreciated that in some embodiments, multiple sets of apertures may be active at any given time, e.g., such that one spray pattern supports fluid flow in multiple angular directions. Likewise, sets or subsets of apertures are not required to be axially aligned with one another as illustrated in a number of the embodiments, e.g., so that spray may be emitted in multiple directions by different apertures in the same set or subset.

Figure 26:
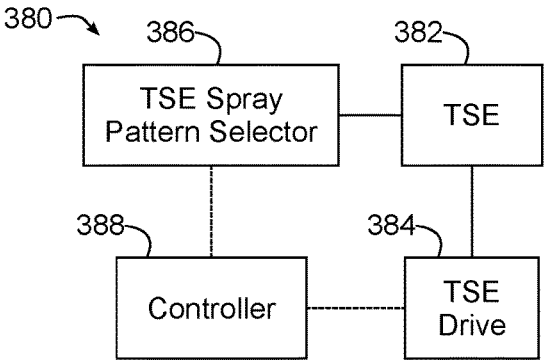
FIG. 26 is a block diagram illustrating an example implementation of a tubular spray element spraying system including a rotation-independent tubular spray element spray pattern selector.

Next, turning to FIG. 26, as noted previously, while some embodiments may rely on rotation of a tubular spray element to control which among multiple selectable spray patterns is selected, in other embodiments, selection of a spray pattern may be made independent of rotation of the tubular spray element. FIG. 26 in particular illustrates a tubular spray element spraying system 380 in which a tubular spray element 382 is coupled to both a tubular spray element drive 384 and a tubular spray element spray pattern selector 386, with both components 384, 386 controlled by a controller 388. In this configuration, the controller may control both the rotation of the tubular spray element and the spray pattern used by the tubular spray element, and may do so independently, e.g., to customize the operation of the tubular spray element for different phases of a wash cycle, for different types of wash cycles, based upon the detected locations and/or types of utensils in a dishwasher, etc.

The tubular spray element spray pattern selector 386 may be implemented in any of the various manners discussed above, although it will be appreciated by those of ordinary skill having the benefit of the instant disclosure that other mechanisms may be used to select between different spray patterns in other embodiments.

Other modifications may be made to the illustrated embodiments without departing from the spirit and scope of the invention. Therefore, the invention lies in the claims hereinafter appended.

What is claimed is:

1. A dishwasher, comprising:

a wash tub;

a fluid supply configured to supply a wash fluid;

a tubular spray element disposed within the wash tub and being rotatable about a longitudinal axis thereof, the tubular spray element including a plurality of apertures in fluid communication with the fluid supply to direct wash fluid into the wash tub, wherein the tubular spray element has a plurality of selectable spray patterns that differ from one another, each of the plurality of selectable spray patterns configured to direct wash fluid from at least a subset of the plurality of apertures, wherein the plurality of selectable spray patterns includes first and second selectable spray patterns that direct wash fluid from different subsets of apertures of the plurality of apertures such that at least one aperture from the plurality of apertures that is used in the first selectable spray pattern is unused in the second selectable spray pattern;

a tubular spray element drive coupled to the tubular spray element and configured to rotate the tubular spray element about the longitudinal axis;

a controller coupled to the tubular spray element drive to control rotation of the tubular spray element, the controller further configured to control selection of a spray pattern among the plurality of selectable spray patterns for the tubular spray element such that the tubular spray element operates using multiple selectable spray patterns during a wash cycle; and a tubular spray element spray pattern selector configured to select from among the plurality of selectable spray patterns, and wherein the controller is configured to control selection of the spray pattern by controlling the tubular spray element spray pattern selector independent of rotation of the tubular spray element by the tubular spray element drive.

2. A dishwasher, comprising:

a wash tub;

a fluid supply configured to supply a wash fluid; and a tubular spray element disposed within the wash tub and being rotatable about a longitudinal axis thereof, the tubular spray element including a plurality of apertures in fluid communication with the fluid supply to direct wash fluid into the wash tub, wherein the tubular spray element has a plurality of selectable spray patterns that differ from one another, each of the plurality of selectable spray patterns configured to direct wash fluid from at least a subset of the plurality of apertures;

wherein the plurality of selectable spray patterns include first and second selectable spray patterns, wherein the tubular spray element is a multi-walled tubular spray element having first and second concentric wall sections, the first concentric wall section including a first set of apertures from the plurality of apertures and the second concentric wall section including a second set of apertures from the plurality of apertures, and wherein the first and second concentric wall sections are movable relative to one another between at least first and second positions, wherein when the first and second concentric wall sections are in the first position, at least a first subset of apertures from the first set of apertures is aligned with at least a first subset of apertures from the second set of apertures such that wash fluid from the fluid supply is emitted through the first subsets of apertures of the first and second sets of apertures to form the first selectable spray pattern, and when the first and second concentric wall sections are in the second position, at least a second subset of apertures from the first set of apertures is aligned with at least a second subset of apertures from the second set of apertures such that wash fluid from the fluid supply is emitted through the second subsets of apertures of the first and second sets of apertures to form the second selectable spray pattern that is different from the first selectable spray pattern.

3. The dishwasher of claim 2, wherein the first and second concentric wall sections fully circumscribe the longitudinal axis of the tubular spray element.

4. The dishwasher of claim 2, wherein at least one of the first and second concentric wall sections does not fully circumscribe the longitudinal axis of the tubular spray element.

5. The dishwasher of claim 2, wherein the first and second concentric wall sections are movable relative to one another along the longitudinal axis of the tubular spray element to select between the first and second selectable spray patterns.

6. The dishwasher of claim 2, wherein the first and second concentric wall sections are rotatable relative to one another about the longitudinal axis of the tubular spray element to select between the first and second selectable spray patterns.

7. The dishwasher of claim 6, further comprising:

first and second rotational limits configured to limit relative rotation of the first and second concentric wall sections beyond each of the first and second positions; and a tubular spray element drive coupled to the tubular spray element and configured to rotate the second concentric wall section of the tubular spray element about the longitudinal axis, wherein when the tubular spray element drive rotates the second concentric wall section of the tubular spray element in a first direction, the first rotational limit maintains the first and second concentric wall sections in the first position, when the tubular spray element drive rotates the second concentric wall section of the tubular spray element in a second direction, the second rotational limit maintains the first and second concentric wall sections in the second position, and when the tubular spray element drive reverses rotation between the first and second directions, the first and second concentric wall sections rotate between the first and second positions.

8. The dishwasher of claim 7, further comprising a frictional coupling coupled to the first concentric wall section to restrict rotation of the first concentric wall section to facilitate rotation of the first and second concentric wall sections between the first and second positions when the tubular spray element drive reverses rotation.

9. The dishwasher of claim 2, wherein the first and second subsets of apertures from the second set of apertures are the same.

10. The dishwasher of claim 9, wherein the first and second subsets of apertures from the first set of apertures are different, and wherein the first concentric wall section is housed within the second concentric wall section.

11. A dishwasher, comprising:

a wash tub;

a fluid supply configured to supply a wash fluid; and a tubular spray element disposed within the wash tub and being rotatable about a longitudinal axis thereof, the tubular spray element including a plurality of apertures in fluid communication with the fluid supply to direct wash fluid into the wash tub, wherein the tubular spray element has a plurality of selectable spray patterns that differ from one another, each of the plurality of selectable spray patterns configured to direct wash fluid from at least a subset of the plurality of apertures;

wherein the plurality of apertures includes a first set of apertures configured to emit a first selectable spray pattern from among the plurality of selectable spray patterns and a second set of apertures configured to emit a second selectable spray pattern from among the plurality of selectable spray patterns that is different from the first selectable spray pattern, wherein the tubular spray element further includes a plurality of internal chambers extending along the longitudinal axis, and wherein the dishwasher further comprises a diverter valve coupled intermediate the tubular spray element and the fluid supply and configured to restrict fluid flow to at least one of the plurality of internal chambers while allowing fluid flow to at least one other of the plurality of internal chambers during rotation of the tubular spray element such that when the first set of apertures is aligned with an internal chamber among the plurality of internal chambers to which fluid flow is allowed and the second set of apertures is aligned with an internal chamber among the plurality of internal chambers to which fluid flow is restricted, wash fluid is emitted from the first set of apertures in the first selectable spray pattern, and when the first set of apertures is aligned with an internal chamber among the plurality of internal chambers to which fluid flow is restricted and the second set of apertures is aligned with an internal chamber among the plurality of internal chambers to which fluid flow is allowed, wash fluid is emitted from the second set of apertures in the second selectable spray pattern.

12. The dishwasher of claim 11, wherein the first and second sets of apertures are circumferentially offset from one another about the longitudinal axis.

13. The dishwasher of claim 12, wherein the tubular spray element includes an outer wall through which the plurality of apertures project and an internal partition that defines the plurality of internal chambers.

14. The dishwasher of claim 13, wherein the internal partition rotates with the outer wall during rotation of the tubular spray element such that the first and second sets of apertures remain aligned with respective first and second internal chambers among the plurality of internal chambers during rotation of the tubular spray element and such that the diverter valve restricts fluid flow to different internal chambers at different rotational positions of the tubular spray element.

15. The dishwasher of claim 13, wherein the outer wall rotates relative to the internal partition during rotation of the tubular spray element such that the first and second sets of apertures align with different internal chambers among the plurality of internal chambers during rotation of the tubular spray element.

16. The dishwasher of claim 15, wherein the internal partition is maintained at a fixed rotational position relative to the diverter valve such that the diverter valve allows fluid flow to at least one of the internal chambers among the plurality of internal chambers throughout rotation of the tubular spray element.

* * * * *